US010837315B2

(12) United States Patent
Lacy et al.

(10) Patent No.: US 10,837,315 B2
(45) Date of Patent: Nov. 17, 2020

(54) TURBINE SHROUD INCLUDING COOLING PASSAGES IN COMMUNICATION WITH COLLECTION PLENUMS

(71) Applicant: General Electric Company, Schenectady, NY (US)

(72) Inventors: Benjamin Paul Lacy, Greer, SC (US); Matthew Scott Lutz, Simpsonville, SC (US); Ibrahim Sezer, Greenville, SC (US); Stephen Paul Wassynger, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 86 days.

(21) Appl. No.: 16/170,331

(22) Filed: Oct. 25, 2018

(65) Prior Publication Data

US 2020/0131929 A1 Apr. 30, 2020

(51) Int. Cl.
*F01D 25/12* (2006.01)
*F01D 11/08* (2006.01)

(52) U.S. Cl.
CPC ..... *F01D 25/12* (2013.01); *F01D 11/08* (2013.01); *F05D 2220/32* (2013.01); *F05D 2230/40* (2013.01); *F05D 2240/55* (2013.01); *F05D 2260/202* (2013.01)

(58) Field of Classification Search
None
See application file for complete search history.

(56) References Cited

U.S. PATENT DOCUMENTS 3,728,039 A * 4/1973 Plemmons ..... B60Q 1/38 415/115
3,825,364 A * 7/1974 Halila ..... F01D 11/12 415/116
4,086,757 A * 5/1978 Karstensen ..... F01D 5/082 415/115
4,752,184 A * 6/1988 Liang ..... F01D 11/08 415/116
5,169,287 A * 12/1992 Proctor ..... F01D 5/182 415/115
5,197,853 A * 3/1993 Creevy ..... F01D 11/005 29/889.22

(Continued)

FOREIGN PATENT DOCUMENTS

WO 2004057159 A1 7/2004

*Primary Examiner* — Michael Lebentritt
(74) *Attorney, Agent, or Firm* — Charlotte Wilson; Hoffman Warnick LLC

(57) ABSTRACT

Turbine shrouds for turbine systems are disclosed. The turbine shrouds may include a forward end, an aft end, a first and second side, an outer surface facing a cooling chamber formed between the body and the turbine casing, and an inner surface facing a hot gas flow path for the turbine system. The turbine shroud may also include at least one collection plenum extending within the body between the forward end and the aft end. Additionally, the turbine shroud may include set of cooling passage(s) extending within the body. Each of the cooling passages of the set of cooling passage(s) may include an inlet portion in fluid communication with the cooling chamber, an outlet portion in fluid communication with the at least one collection plenum, and an intermediate portion fluidly coupling the inlet portion and the outlet portion.

17 Claims, 33 Drawing Sheets

(56) References Cited

U.S. PATENT DOCUMENTS 5,584,651 A * 12/1996 Pietraszkiewicz ..... F01D 11/08 415/115
6,179,557 B1 * 1/2001 Dodd ..... F01D 9/00 415/108
6,241,467 B1 * 6/2001 Zelesky ..... F01D 9/04 415/115
6,354,795 B1 * 3/2002 White ..... F01D 11/24 415/116
6,779,597 B2 8/2004 DeMarche et al.
7,740,444 B2 * 6/2010 Lee ..... F01D 11/24 415/1
8,814,507 B1 * 8/2014 Campbell ..... F01D 5/08 415/173.1
9,080,458 B2 * 7/2015 Romanov ..... F01D 11/08
9,103,225 B2 * 8/2015 Lutjen ..... F01D 11/08
9,670,785 B2 6/2017 Johns et al.
9,719,372 B2 * 8/2017 Ballard, Jr. ..... F01D 25/14
10,107,128 B2 * 10/2018 Romanov ..... F01D 11/08
10,221,717 B2 * 3/2019 Manchikanti ..... F01D 25/24
2005/0232752 A1 * 10/2005 Meisels ..... F01D 25/24 415/116
2005/0281663 A1 * 12/2005 Trindade ..... F01D 5/18 415/1
2009/0035125 A1 * 2/2009 Fujimoto ..... F01D 11/24 415/116
2010/0111670 A1 * 5/2010 Shapiro ..... F01D 11/08 415/115
2010/0196160 A1 * 8/2010 Hudson ..... B22C 9/103 416/95
2011/0044804 A1 * 2/2011 DiPaola ..... F01D 9/04 415/173.1
2012/0020768 A1 * 1/2012 Krueckels ..... F01D 5/187 415/1
2012/0201650 A1 * 8/2012 Suthar ..... F01D 11/10 415/1
2012/0219401 A1 * 8/2012 Rawlinson ..... F01D 11/122 415/115
2013/0142649 A1 * 6/2013 Collier ..... F01D 5/187 416/1
2013/0192257 A1 * 8/2013 Horine ..... F01D 11/08 60/796
2013/0315719 A1 * 11/2013 Rogers ..... F01D 9/04 415/175
2014/0023497 A1 * 1/2014 Giglio ..... F01D 5/225 416/1
2014/0321961 A1 * 10/2014 Beattie ..... F01D 5/081 415/1
2015/0007581 A1 * 1/2015 Sezer ..... F01D 11/24 60/806
2015/0118022 A1 * 4/2015 Weber ..... F01D 11/005 415/116
2016/0169037 A1 * 6/2016 Lefebvre ..... F01D 11/005 415/1
2016/0258311 A1 * 9/2016 Varney ..... F01D 25/12
2016/0362985 A1 12/2016 Lacy et al.
2017/0101892 A1 4/2017 Dutta et al.
2017/0145845 A1 * 5/2017 Vetters ..... F01D 9/02
2017/0175572 A1 * 6/2017 Vetters ..... F01D 25/12
2017/0298823 A1 * 10/2017 Harding ..... F23R 3/005
2018/0073391 A1 * 3/2018 Jennings ..... F01D 25/14
2018/0230806 A1 * 8/2018 Zemitis ..... F01D 5/20
2018/0363499 A1 * 12/2018 Smoke ..... F01D 25/12
2019/0170001 A1 * 6/2019 Frach ..... F01D 5/187
2019/0178102 A1 * 6/2019 Synnott ..... F01D 25/12

* cited by examiner

TURBINE SHROUD INCLUDING COOLING PASSAGES IN COMMUNICATION WITH COLLECTION PLENUMS

BACKGROUND OF THE INVENTION

The disclosure relates generally to turbine shrouds for turbine systems, and more particularly, to turbine shrouds that include a plurality of cooling passages in fluid communication with collection plenums formed therein.

Conventional turbomachines, such as gas turbine systems, are utilized to generate power for electric generators. In general, gas turbine systems generate power by passing a fluid (e.g., hot gas) through a turbine component of the gas turbine system. More specifically, inlet air may be drawn into a compressor and may be compressed. Once compressed, the inlet air is mixed with fuel to form a combustion product, which may be ignited by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stationary nozzles or vanes positioned between the rotating blades. As the plurality of rotating blades rotate the rotor of the gas turbine system, a generator, coupled to the rotor, may generate power from the rotation of the rotor.

To improve operational efficiencies, turbine components may include turbine shrouds and/or nozzle bands to further define the flow path of the operational fluid. Turbine shrouds, for example, may be positioned radially adjacent rotating blades of the turbine component and may direct the operational fluid within the turbine component and/or define the outer bounds of the fluid flow path for the operational fluid. During operation, turbine shrouds may be exposed to high temperature operational fluids flowing through the turbine component. Over time and/or during exposure, the turbine shrouds may undergo undesirable thermal expansion. The thermal expansion of turbine shrouds in some cases may reduce shroud lifespan and/or may impede seal formation within the turbine component for defining the fluid flow path for the operational fluid. Over time, repeated thermal expansion of the shroud may cause operational fluid to leak from the flow path, which in turn may reduce the operational efficiency of the turbine component and the entire turbine system.

To minimize thermal expansion, turbine shrouds are typically cooled. Conventional processes for cooling turbine shrouds include impingement cooling. Impingement cooling utilizes holes or apertures formed through the turbine shroud to provide cooling air to various portions of the turbine shroud during operation. However, conventional impingement cooling may not be usable or efficient in locations of the system that require thicker walls and/or added structures, such as near the edges of the components included within the system.

BRIEF DESCRIPTION OF THE INVENTION

A first aspect of the disclosure provides a turbine shroud coupled to a turbine casing of a turbine system. The turbine shroud includes: a forward end; an aft end positioned opposite the forward end; a first side extending between forward end and aft end; a second side extending between forward end and aft end, opposite the first side; an outer surface facing a cooling chamber formed between the body and the turbine casing; and an inner surface facing a hot gas flow path for the turbine system; at least one collection plenum extending within the body between the forward end and the aft end; and at least one set of cooling passages extending within the body, each of the cooling passages of the at least one set of cooling passages including: an inlet portion extending through the outer surface and in fluid communication with the cooling chamber formed between the body and the turbine casing; an outlet portion in fluid communication with the at least one collection plenum; and an intermediate portion fluidly coupling the inlet portion and the outlet portion.

A second aspect of the disclosure provides a turbine shroud coupled to a turbine casing of a turbine system. The turbine shroud includes: a body including: a forward end; an aft end positioned opposite the forward end; a first side extending between forward end and aft end; a second side extending between forward end and aft end, opposite the first side; an outer surface facing a cooling chamber formed between the body and the turbine casing; and an inner surface facing a hot gas flow path for the turbine system; at least one collection plenum extending within the body between the first side and the second side; and at least one set of cooling passages extending within the body, each of the cooling passages of the at least one set of cooling passages including: an inlet portion extending through the outer surface and in fluid communication with the cooling chamber formed between the body and the turbine casing; an outlet portion in fluid communication with the at least one collection plenum; and an intermediate portion fluidly coupling the inlet portion and the outlet portion.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
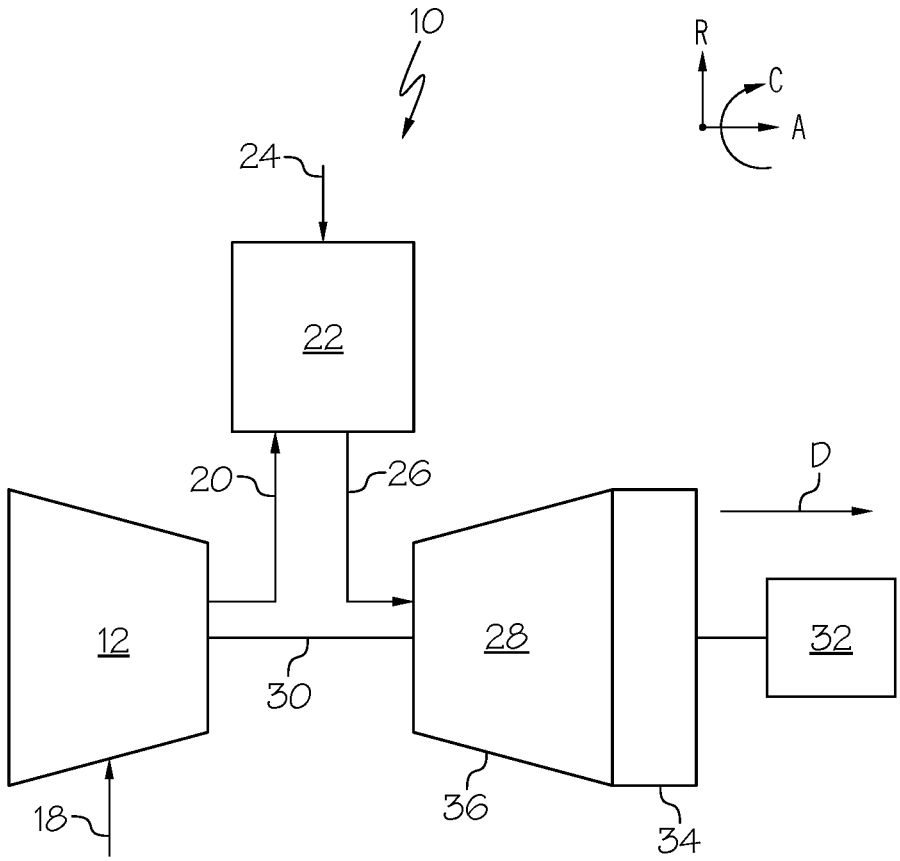
FIG. 1 shows a schematic diagram of a gas turbine system, according to embodiments of the disclosure.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along a direction "R" (see, FIG. 1), which is substantially perpendicular with axis A and intersects axis A at only one location. Finally, the term "circumferential" refers to movement or position around axis A (e.g., direction "C").

As indicated above, the disclosure provides turbine shrouds for turbine systems, and more particularly, turbine shrouds that include a plurality of cooling passages in fluid communication with collection plenums formed therein.

These and other embodiments are discussed below with reference to FIGS. 1-33. However, those skilled in the art will readily appreciate that the detailed description given herein with respect to these Figures is for explanatory purposes only and should not be construed as limiting.

FIG. 1 shows a schematic view of an illustrative gas turbine system 10. Gas turbine system 10 may include a compressor 12. Compressor 12 compresses an incoming flow of air 18. Compressor 12 delivers a flow of compressed air 20 to a combustor 22. Combustor 22 mixes the flow of compressed air 20 with a pressurized flow of fuel 24 and ignites the mixture to create a flow of combustion gases 26. Although only a single combustor 22 is shown, gas turbine system 10 may include any number of combustors 22. The flow of combustion gases 26 is in turn delivered to a turbine 28, which typically includes a plurality of turbine blades including airfoils (see, FIG. 2) and stator vanes (see, FIG. 2). The flow of combustion gases 26 drives turbine 28, and more specifically the plurality of turbine blades of turbine 28, to produce mechanical work. The mechanical work produced in turbine 28 drives compressor 12 via a rotor 30 extending through turbine 28, and may be used to drive an external load 32, such as an electrical generator and/or the like.

Gas turbine system 10 may also include an exhaust frame 34. As shown in FIG. 1, exhaust frame 34 may be positioned adjacent to turbine 28 of gas turbine system 10. More specifically, exhaust frame 34 may be positioned adjacent to turbine 28 and may be positioned substantially downstream of turbine 28 and/or the flow of combustion gases 26 flowing from combustor 22 to turbine 28. As discussed herein, a portion (e.g., outer casing) of exhaust frame 34 may be coupled directly to an enclosure, shell, or casing 36 of turbine 28.

Subsequent to combustion gases 26 flowing through and driving turbine 28, combustion gases 26 may be exhausted, flow-through and/or discharged through exhaust frame 34 in a flow direction (D). In the non-limiting example shown in FIG. 1, combustion gases 26 may flow through exhaust frame 34 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 26 may discharge from exhaust frame 34, and may flow in the flow direction (D) into a heat recovery steam generator of the combined cycle power plant.

Figure 2:
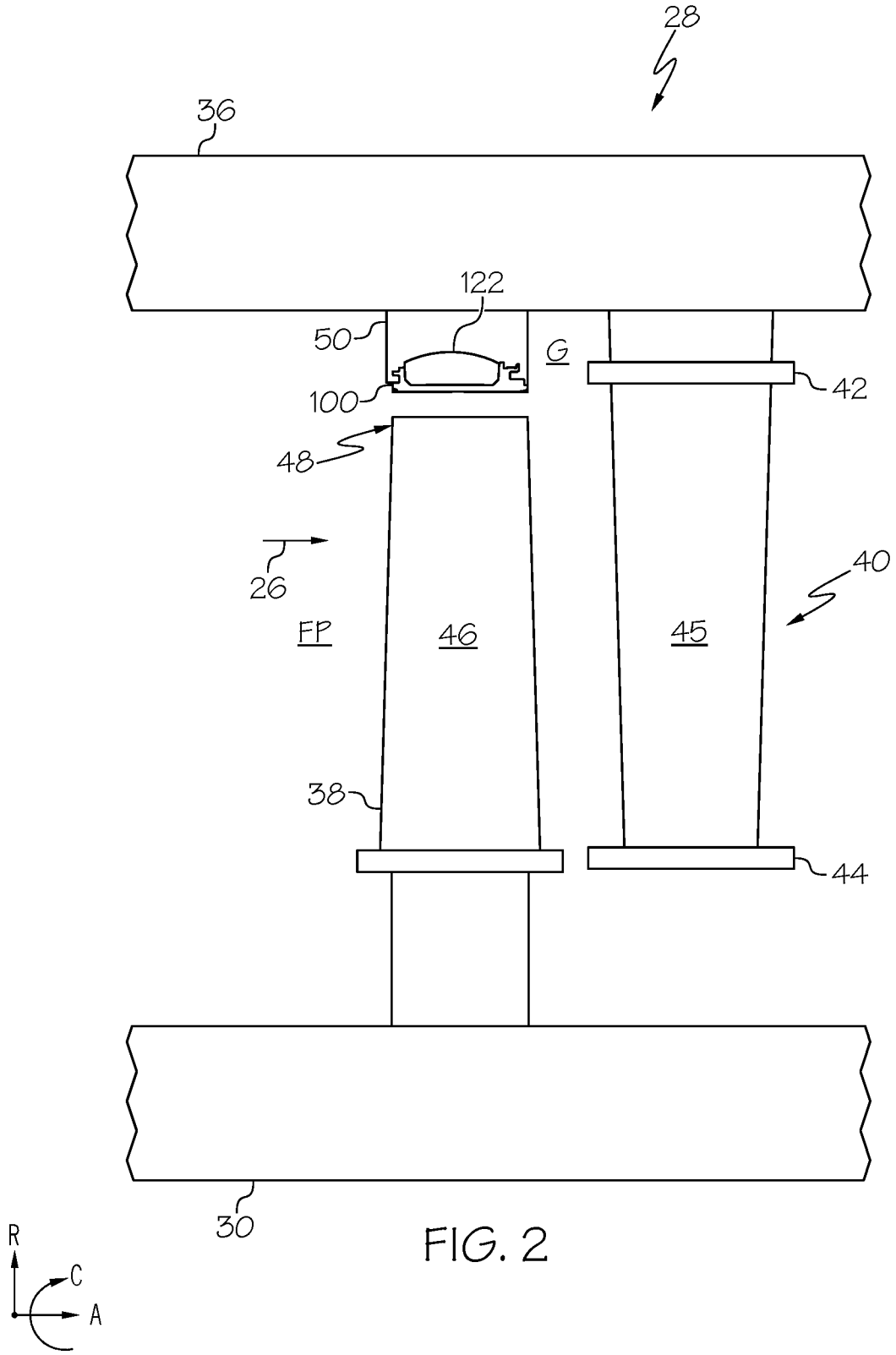
FIG. 2 shows a side view of a portion of a turbine of the gas turbine system of FIG. 1 including a turbine blade, a stator vane, a rotor, a casing, and a turbine shroud, according to embodiments of the disclosure.

Turning to FIG. 2, a portion of turbine 28 is shown. Specifically, FIG. 2 shows a side view of a portion of turbine 28 including a first stage of turbine blades 38 (one shown), and a first stage of stator vanes 40 (one shown) coupled to casing 36 of turbine 28. As discussed herein, each stage (e.g., first stage, second stage (not shown), third stage (not shown)) of turbine blades 38 may include a plurality of turbine blades 38 that may be coupled to and positioned circumferentially around rotor 30 and may be driven by combustion gases 26 to rotate rotor 30. Additionally, each stage (e.g., first stage, second stage (not shown), third stage (not shown)) of stator vanes 40 may include a plurality of stator vanes that may be coupled to and positioned circumferentially about casing 36 of turbine 28. In the non-limiting example shown in FIG. 2, stator vanes 40 may include an outer platform 42 positioned adjacent and/or coupling stator vanes 40 to casing 26 of turbine 28, an inner platform 44 positioned opposite the outer platform 42, and an airfoil 45 positioned between outer platform 42 and inner platform 44. Outer platform 42 and inner platform 44 of stator vanes 40 may define a flow path (FP) for the combustion gases 26 flowing over stator vanes 40.

Each turbine blade 38 of turbine 28 may include an airfoil 46 extending radially from rotor 30 and positioned within the flow path (FP) of combustion gases 26 flowing through turbine 28. Each airfoil 46 may include a tip portion 48 positioned radially opposite rotor 30. Turbine blades 38 and stator vanes 40 may also be positioned axially adjacent to one another within casing 36. In the non-limiting example shown in FIG. 2, first stage of stator vanes 40 may be positioned axially adjacent and downstream of first stage of turbine blades 38. Not all turbine blades 38, stator vanes 40 and/or all of rotor 30 of turbine 28 are shown for clarity. Additionally, although only a portion of the first stage of turbine blades 38 and stator vanes 40 of turbine 28 are shown in FIG. 2, turbine 28 may include a plurality of stages of turbine blades and stator vanes, positioned axially throughout casing 36 of turbine 28.

Turbine 28 of gas turbine system 10 (see, FIG. 1) may also include a plurality of turbine shrouds 100. For example, turbine 28 may including a first stage of turbine shrouds 100 (one shown). The first stage of turbine shrouds 100 may correspond with the first stage of turbine blades 38 and/or the first stage of stator vanes 40. That is, and as discussed herein, the first stage of turbine shrouds 100 may be positioned within turbine 28 adjacent the first stage of turbine blades 38 and/or the first stage of stator vanes 40 to interact with and provide a seal in the flow path (FP) of combustion gases 26 flowing through turbine 28. In the non-limiting example shown in FIG. 2, the first stage of turbine shrouds 100 may be positioned radially adjacent and/or may substantially surround or encircle the first stage of turbine blades 38. First stage of turbine shrouds 100 may be positioned radially adjacent tip portion 48 of airfoil 46 for turbine blade 38. Additionally, first stage of turbine shrouds 100 may also be positioned axially adjacent and/or upstream of the first stage of stator vanes 40 of turbine 28.

Similar to stator vanes 40, first stage of turbine shrouds 100 may include a plurality of turbine shrouds 100 that may be coupled to and positioned circumferentially about casing 36 of turbine 28. In the non-limiting example shown in FIG. 2 turbine shrouds 100 may be coupled to casing 36 via coupling component 50 extending radially inward from casing 36 of turbine 28. Coupling component 50 may be configured to be coupled to and/or receive fasteners or hooks 102, 104 (FIG. 3) of turbine shrouds 100 to couple, position, and/or secure turbine shrouds 100 to casing 36 of turbine 28. In the non-limiting example, coupling component 50 may be coupled and/or fixed to casing 36 of turbine 28. In another non-limiting example (not shown), coupling component 50 may be formed integral with casing 36 for coupling, positioning, and/or securing turbine shrouds 100 to casing 36. Similar to turbine blades 38 and/or stator vanes 40, although only a portion of the first stage of turbine shrouds 100 of turbine 28 is shown in FIG. 2, turbine 28 may include a plurality of stages of turbine shrouds 100, positioned axially throughout casing 36 of turbine 28.

Figure 3:
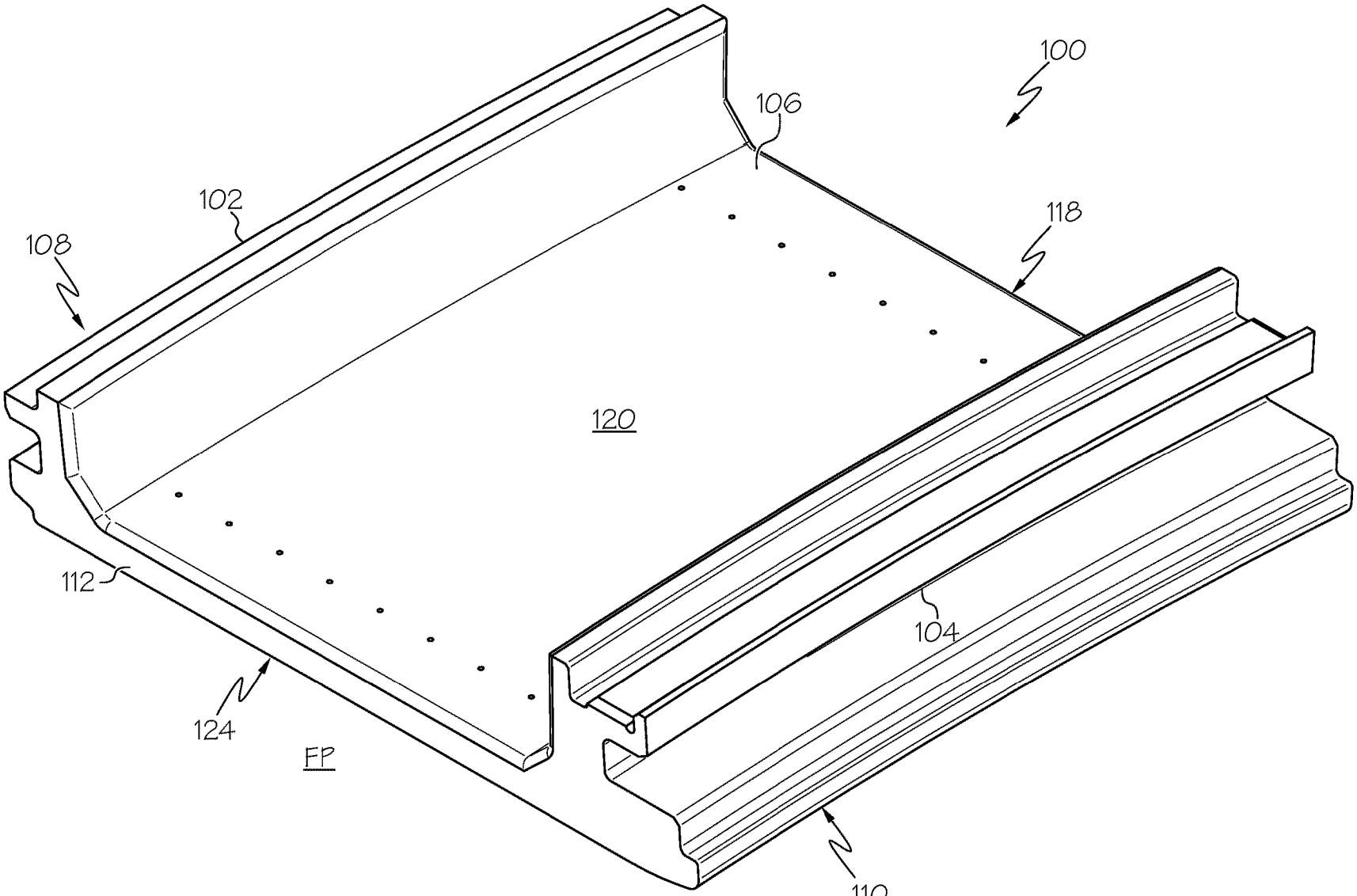
FIG. 3 shows an isometric view of the turbine shroud of FIG. 2, according to embodiments of the disclosure.
Figure 4:
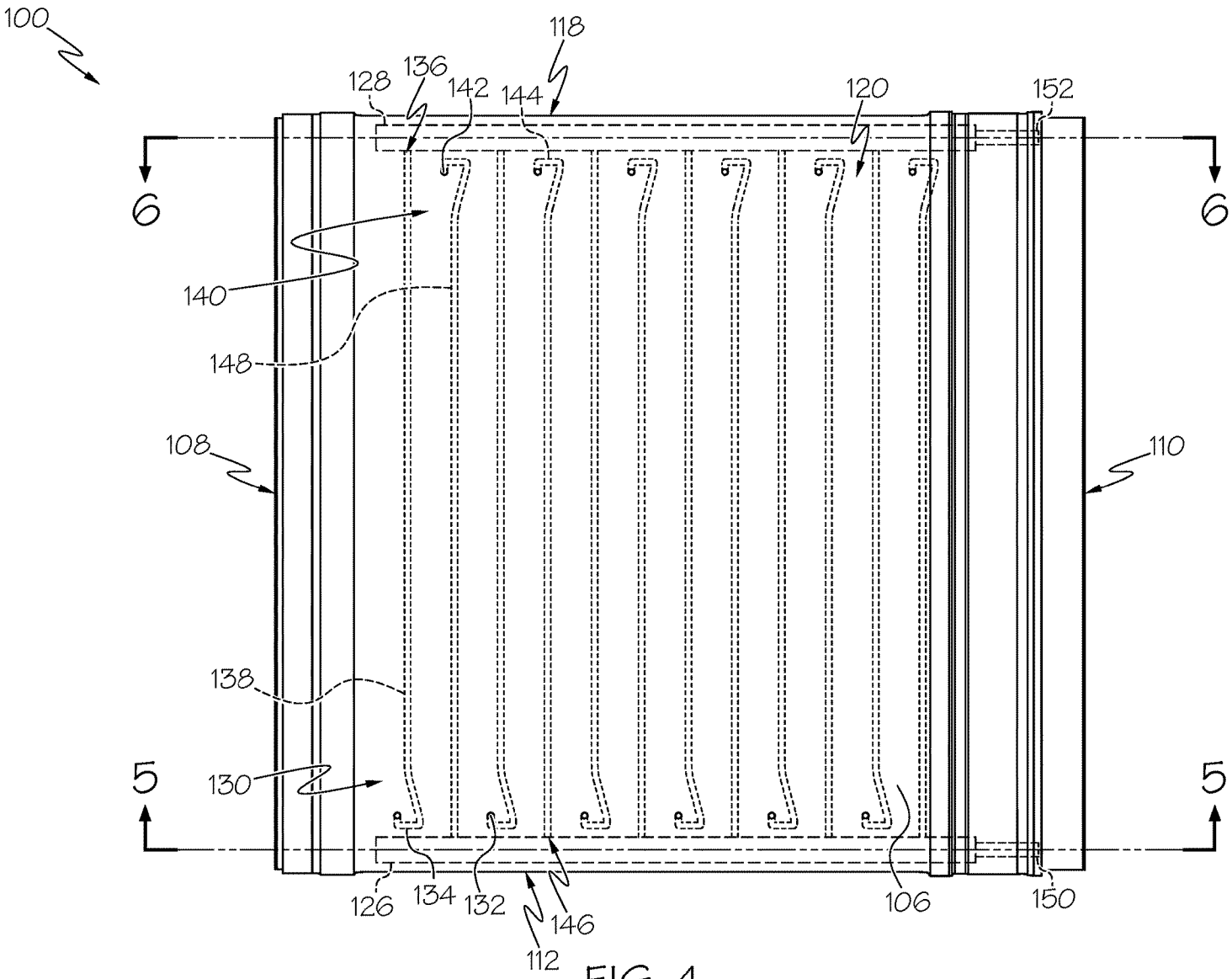
FIG. 4 shows a top view of the turbine shroud of FIG. 3 including at least one collection plenum, according to embodiments of the disclosure.
Figure 5:
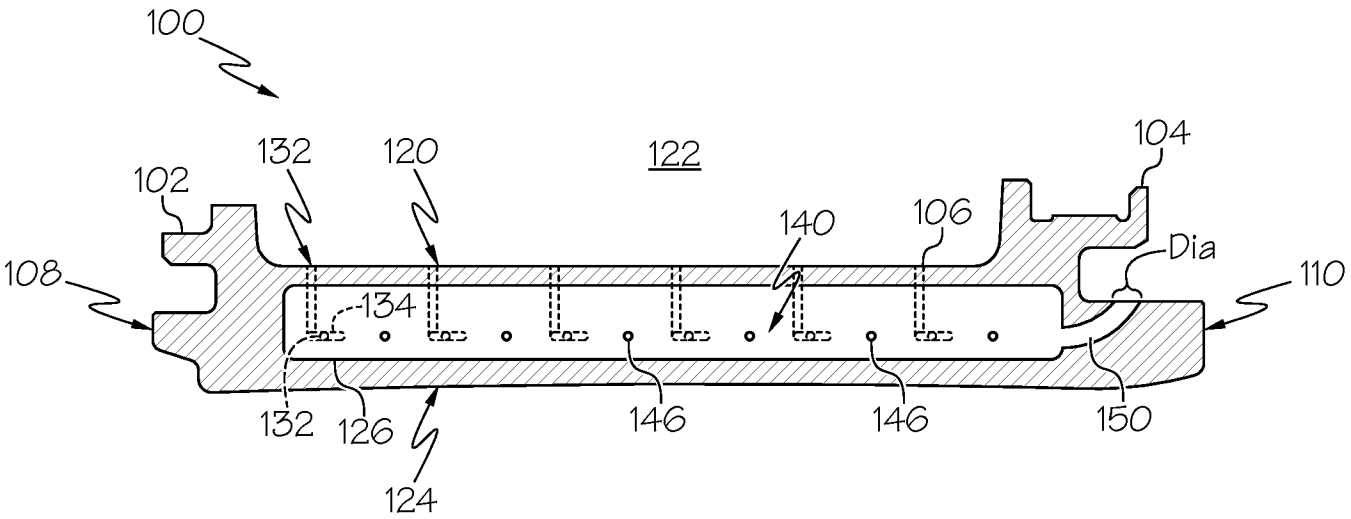
FIG. 5 shows a cross-sectional side view of the turbine shroud taken along line 5-5 in FIG. 4, according to embodiments of the disclosure.
Figure 6:
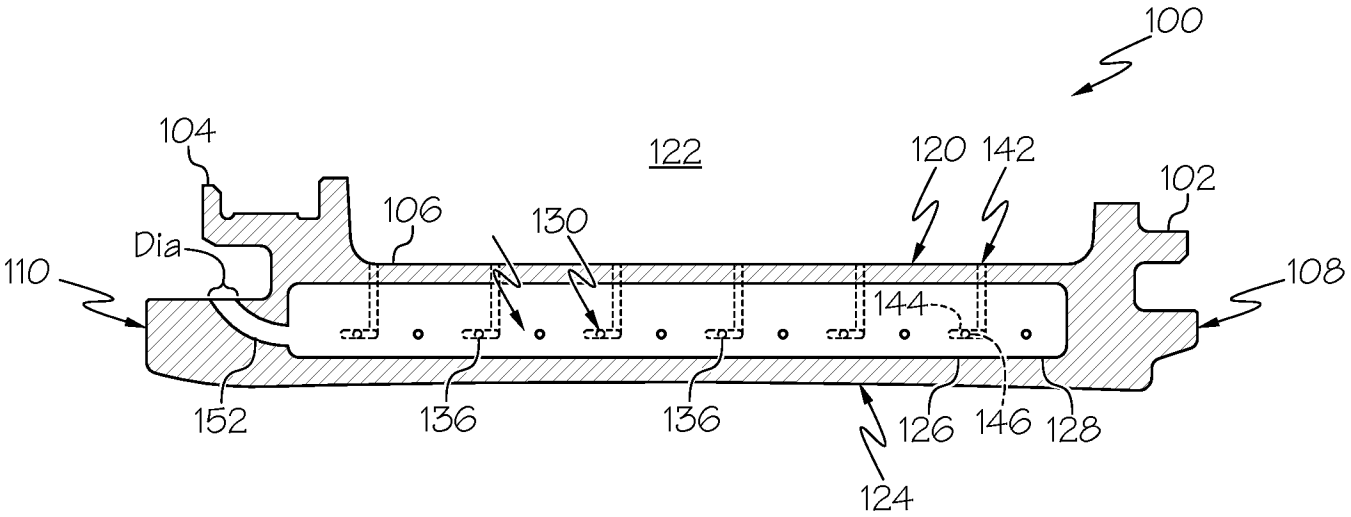
FIG. 6 shows a cross-sectional side view of the turbine shroud taken along line 6-6 in FIG. 4, according to embodiments of the disclosure.

Turning to FIGS. 3-6 show various views of turbine shroud 100 of turbine 28 for gas turbine system 10 of FIG. 1. Specifically, FIG. 3 shows an isometric view of turbine shroud 100, FIG. 4 shows a top view of turbine shroud 100, FIG. 5 shows a cross-sectional side view of turbine shroud 100 taken along line 5-5 in FIG. 4, and FIG. 6 shows a cross-sectional side view of turbine shroud 100 taken along line 6-6 in FIG. 4.

Turbine shroud 100 may include a body 106. In the non-limiting example shown in FIGS. 3-6, turbine shroud 100 may include and/or be formed as a unitary body 106 such that turbine shroud 100 is a single, continuous, and/or non-disjointed component or part. In the non-limiting example shown in FIGS. 3-6, because turbine shroud 100 is formed from unitary body 106, turbine shroud 100 may not require the building, joining, coupling, and/or assembling of various parts to completely form turbine shroud 100, and/or may not require building, joining, coupling, and/or assembling of various parts before turbine shroud 100 can be installed and/or implemented within turbine system 10 (see, FIG. 2). Rather, once single, continuous, and/or non-disjointed unitary body 106 for turbine shroud 100 is built, as discussed herein, turbine shroud 100 may be immediately installed within turbine system 10.

In the non-limiting example, unitary body 106 of turbine shroud 100, and the various components and/or features of turbine shroud 100, may be formed using any suitable additive manufacturing process(es) and/or method. For example, turbine shroud 100 including unitary body 106 may be formed by direct metal laser melting (DMLM) (also referred to as selective laser melting (SLM)), direct metal laser sintering (DMLS), electronic beam melting (EBM), stereolithography (SLA), binder jetting, or any other suitable additive manufacturing process(es). Additionally, unitary body 106 of turbine shroud 100 may be formed from any material that may be utilized by additive manufacturing process(es) to form turbine shroud 100, and/or capable of withstanding the operational characteristics (e.g., exposure temperature, exposure pressure, and the like) experienced by turbine shroud 100 within gas turbine system 10 during operation.

In another non-limiting example, body 106 of turbine shroud 100 may be formed as multiple and/or distinct portions or components. For example, and as discussed herein, body 106 of turbine shroud 100 may be formed from a first component that may include hooks 102, 104 and an inner surface, and second component that may include the upper surface of turbine shroud 100. The two components forming body 106 of turbine shroud 100 may be joined, coupled, and/or affixed to one another to form turbine shroud 100 before being installed in turbine 28 within gas turbine system 10. Each component forming body 106, and the various components and/or features of turbine shroud 100, may be formed using any suitable manufacturing process(es) and/or method. For example, turbine shroud 100 including body 106 including the two, distinct components may be formed by milling, turning, cutting, casting, molding, drilling, and the like.

Turbine shroud 100 may also include various ends, sides, and/or surfaces. For example, and as shown in FIGS. 3 and 4, body 106 of turbine shroud 100 may include a forward end 108 and an aft end 110 positioned opposite forward end 108. Forward end 108 may be positioned upstream of aft end 110, such that combustion gases 26 flowing through the flow path (FP) defined within turbine 28 may flow adjacent forward end 108 before flowing by adjacent aft end 110 of body 106 of turbine shroud 100. As shown in FIGS. 3 and 4, forward end 108 may include first hook 102 configured to be coupled to and/or engage coupling component 48 of casing 36 for turbine 28 to couple, position, and/or secure turbine shrouds 100 within casing 36 (see, FIG. 2). Additionally, aft end 110 may include second hook 104 positioned and/or formed on body 106 opposite first hook 102. Similar to first hook 102, second hook 104 may be configured to be coupled to and/or engage coupling component 48 of casing 36 for turbine 28 to couple, position, and/or secure turbine shrouds 100 within casing 36 (see, FIG. 2).

Additionally, body 106 of turbine shroud 100 may also include a first side 112, and a second side 118 positioned opposite first side 112. As shown in FIGS. 3 and 4, first side 112 and second side 118 may extend and/or be formed between forward end 108 and aft end 110. First side 112 and second side 118 of body 106 may be substantially closed and/or may include solid end walls or caps. As such, and as discussed herein, the solid end walls of first side 112 and second side 118 may substantially prevent fluid within turbine 28 (e.g., combustion gases 26, cooling fluids) from entering turbine shroud 100, and/or cooling fluid from exiting internal portions (e.g., passages, plenums) formed within turbine shroud 100 via first side 112 and/or second side 118.

As shown in FIGS. 3-5 body 106 of turbine shroud 100 may also include an outer surface 120. Outer surface 120 may face a cooling chamber 122 formed between body 106 and turbine casing 36 (see, FIG. 2). More specifically, outer surface 120 may be positioned, formed, face, and/or directly exposed in cooling chamber 122 formed between body 106 of turbine shroud 100 and turbine casing 36 of turbine 28. As discussed herein, cooling chamber 122 formed between body 106 of turbine shroud 100 and turbine casing 36 may receive and/or provide cooling fluid to turbine shroud 100 during operation of turbine 28. In addition to facing cooling chamber 122, outer surface 120 of body 106 for turbine shroud 100 may also be formed and/or positioned between forward end 108 and aft end 110, as well as first side 112 and second side 118, respectively.

Body 106 of turbine shroud 100 may also include inner surface 124 formed opposite outer surface 120. That is, and as shown in the non-limiting example in FIGS. 3, 5, and 6, inner surface 124 of body 106 of turbine shroud 100 may be formed radially opposite outer surface 120. Briefly returning to FIG. 2, and with continued reference to FIGS. 3, 5, and 6, inner surface 124 may face the hot gas flow path (FP) of combustion gases 26 flowing through turbine 28 (see, FIG. 2). More specifically, inner surface 124 may be positioned, formed, face, and/or directly exposed to the hot gas flow path (FP) of combustion gases 26 flowing through turbine casing 36 of turbine 28 for gas turbine system 10. Additionally as shown in FIG. 2, inner surface 124 of body 106 for turbine shroud 100 may be positioned radially adjacent tip portion 48 of airfoil 46. In addition to facing the hot gas flow path (FP) of combustion gases 26, and similar to outer surface 120, inner surface 124 of body 106 for turbine shroud 100 may also be formed and/or positioned between forward end 108 and aft end 110, and first side 112 and second side 118, respectively.

Turning to FIGS. 4-6, additional features of turbine shroud 100 are now discussed. Turbine shroud 100 may include at least one collection plenum extending within body 106. In the non-limiting example shown in FIGS. 4 and 5, turbine shroud 100 may include a first side collection plenum 126. First side collection plenum 126 may extend within body 106 from forward end 108 to aft end 110. Additionally, first side collection plenum 126 may extend within body 106 adjacent to and/or substantially parallel with first side 112 of body 106. Briefly turning to FIG. 5, first side collection plenum 126 may extend within body 106 between outer surface 120 and inner surface 124 of body 106.

Additionally, and as shown in the non-limiting example shown in FIGS. 4 and 6, turbine shroud 100 may also include a second side collection plenum 128. Second side collection plenum 128 may be formed in body 106 opposite first side collection plenum 126. That is, second side collection plenum 128 may extend within body 106 from forward end 108 to aft end 110, and may extend adjacent to and/or substantially parallel with second side 118 of body 106. Briefly turning to FIG. 6, and similar to first side collection plenum 126, second side collection plenum 128 may extend within body 106 between outer surface 120 and inner surface 124 of body 106.

Turbine shroud 100 may also include at least one set of cooling passages formed therein for cooling turbine shroud 100 during operation of turbine 28 of gas turbine system 10. As shown in FIG. 4, turbine shroud 100 may include a first set of cooling passages 130 formed, positioned, and/or extending within body 106 of turbine shroud 100. More specifically, first set of cooling passages 130 (shown in phantom in FIG. 4) of turbine shroud 100 may extend within body 106 between and/or from first side 112 to second side 118. First set of cooling passages 130 extending within body 106 of turbine shroud 100 may include a plurality of cooling passages formed therein. Although first set of cooling passages 130 is shown to include 10 cooling passages extending within body 106, it is understood that first set of cooling passages 130 of turbine shroud 100 may include more or less cooling passages. The number of cooling passages shown in the non-limiting examples is illustrative.

First set of cooling passages 130 may include a plurality of distinct sections, and/or portions. For example, each cooling passage of the first set of cooling passages 130 may include an inlet portion 132 positioned and/or formed adjacent first side 112 of body 106 for turbine shroud 100. Additionally, and as shown in FIG. 4, inlet portion 132 for each of the first set of cooling passages 130 may be positioned and/or formed adjacent first side collection plenum 126. In the non-limiting example, first side collection plenum 126 is positioned and/or formed within body 106 between first side 112 of body 106 and inlet portion 132 for each of the first set of cooling passages 130. Inlet portion 132 for the first set of cooling passages 130 may extend through outer surface 120 of body 106 for turbine shroud 100. More specifically, inlet portion 132 may extend and/or may be formed through outer surface 120 of body 106, and may be in fluid communication with cooling chamber 122 formed between body 106 and turbine casing 36 (see, FIG. 2). As discussed herein, inlet portion 132 for the first set of cooling passages 130 may be in fluid communication with cooling chamber 122 to receive a cooling fluid in order to cool turbine shroud 100.

In the non-limiting example shown in FIG. 4, inlet portion 132 may also include a hook-shaped section 134. Hook-shaped section 134 of inlet portion 132 may include a hook and/or turn orientation or curvature, and/or may include a predetermined turn radius. For example, hook-shaped section 134 may initially extend toward first side 112, and then may turn toward aft end 110, and may extend toward second side 118. The orientation or curvature of the hook-shaped section 134 of inlet portion 132 enables more cooling passages of the first set of cooling passages 130 to be disposed, formed, and/or extend within body 106. Additionally, hook-shaped section 134 may provide a larger cooling region within body 106, adjacent first side 112, by increasing a length of each of the first set of cooling passages 130 formed in turbine shroud 100. In addition, hook-shaped section 134 may allow for better spacing of additional portions (e.g., intermediate portions) of each of the first set of cooling passages 130 formed in turbine shroud 100. In additional non-limiting examples, hook-shaped section 134 may be adjusted to allow for improved spacing of each of the first set of cooling passages 130, such that first set of cooling passages 130 may be more condense and/or formed closer together in turbine shroud 100 in higher heat zones.

Each cooling passage of the first set of cooling passages 130 may also include an outlet portion 136. In the non-limiting example shown in FIG. 4, outlet portion 136 may be positioned and/or formed adjacent second side 118 of body 106 for turbine shroud 100. Additionally, and as shown in FIG. 4, outlet portion 136 for each of the first set of cooling passages 130 may be positioned and/or formed adjacent second side collection plenum 128. As such, second side collection plenum 128 is positioned and/or formed within body 106 between second side 118 of body 106 and outlet portion 136 for each of the first set of cooling passages 130. Turning briefly to FIG. 5, and with continued reference to FIG. 4, outlet portion 136 for each of the first set of cooling passages 130 may be in fluid communication with second side collection plenum 128. As discussed herein, outlet portion 136 for the first set of cooling passages 130 may be in fluid communication with second side collection plenum 128 to provide or expel the cooling fluid flowing through the first set of cooling passages 130 into the second side collection plenum 128 when cooling turbine shroud 100.

As shown in FIG. 4, each of the first set of cooling passages 130 may also include an intermediate portion 138. Intermediate portion 138 may fluidly couple inlet portion 132 and outlet portion 136 of the first set of cooling passages 130. That is, intermediate portion 138 may be formed and/or extend within body 106 of turbine shroud 100 between inlet portion 132 and outlet portion 136 to fluidly couple inlet portion 132 and outlet portion 136. Additionally, intermediate portion 138 may extend within and/or span across body 106 between first side 112 and second side 118. In the non-limiting example shown in FIG. 4, intermediate portion 138 of each of the first set of cooling passages 130 may be substantially linear when extending between inlet portion 132 and outlet portion 136.

In the non-limiting example shown in FIG. 4, turbine shroud 100 may also include a second set of cooling passages 140 formed, positioned, and/or extending within body 106 of turbine shroud 100. More specifically, second set of cooling passages 140 (shown in phantom in FIG. 4) of turbine shroud 100 may extend within body 106 between and/or from second side 118 to first side 112. Second set of cooling passages 140 extending within body 106 of turbine shroud 100 may include a plurality of cooling passages formed therein. Similar to the first set of cooling passages 130, the number of cooling passages included in the non-limiting example of the second set of cooling passages 140 is illustrative. Additionally, the second set of cooling passages 140 may include the same number, more, or less cooling passages than the number of cooling passages of the first set of cooling passages 130.

Similar to first set of cooling passages 130, second set of cooling passages 140 may include a plurality of distinct sections, and/or portions. For example, each cooling passage of the second set of cooling passages 140 may include an inlet portion 142 positioned and/or formed adjacent second side 118 of body 106 for turbine shroud 100. Additionally, and as shown in FIG. 4, inlet portion 142 for each of the second set of cooling passages 140 may be positioned and/or formed adjacent second side collection plenum 128. In the non-limiting example, second side collection plenum 128 is positioned and/or formed within body 106 between second side 118 of body 106 and inlet portion 142 for each of the second set of cooling passages 140. Inlet portion 142 for the second set of cooling passages 140 may extend through outer surface 120 of body 106 for turbine shroud 100. More specifically, inlet portion 142 may extend and/or may be formed through outer surface 120 of body 106, and may be in fluid communication with cooling chamber 122 formed between body 106 and turbine casing 36 (see, FIG. 2). As discussed herein, inlet portion 142 for the second set of cooling passages 140 may be in fluid communication with cooling chamber 122 to receive a cooling fluid in order to cool turbine shroud 100.

In the non-limiting example shown in FIG. 4, inlet portion 142 may also include a hook-shaped section 144. Hook-shaped section 144 of inlet portion 142 may include a hook and/or turn orientation or curvature, and/or may include a predetermined turn radius, similar to hook-shaped section 134 of inlet portion 132 for the first set of cooling passages 130. Hook-shaped section 144 may initially extend toward second side 118, and then may turn toward aft end 110, and may extend toward first side 112. Similar hook-shaped section 134 for the first set of cooling passages 130, hook-shaped section 144 of inlet portion 142 enables more cooling passages of the second set of cooling passages 140 to be disposed, formed, and/or extend within body 106, and may provide a larger cooling region within body 106, adjacent second side 118 by increasing a length of each of the second set of cooling passages 140 formed in turbine shroud 100. Additionally, hook-shaped section 144 may allow for better spacing of additional portions (e.g., intermediate portions) of each of the second set of cooling passages 140 formed in turbine shroud 100, and may improve spacing of each of the second set of cooling passages 140.

Each cooling passage of the second set of cooling passages 140 may also include an outlet portion 146. In the non-limiting example shown in FIG. 4, outlet portion 146 may be positioned and/or formed adjacent first side 112 of body 106 for turbine shroud 100. Additionally, and as shown in FIG. 4, outlet portion 146 for each of the second set of cooling passages 140 may be positioned and/or formed adjacent first side collection plenum 126. As such, first side collection plenum 126 is positioned and/or formed within body 106 between first side 112 of body 106 and outlet portion 146 for each of the second set of cooling passages 140. Turning briefly to FIG. 6, and with continued reference to FIG. 4, outlet portion 146 for each of the second set of cooling passages 140 may also be in fluid communication with first side collection plenum 126. As discussed herein, outlet portion 146 for the second set of cooling passages 140 may be in fluid communication with first side collection plenum 126 to provide or expel the cooling fluid flowing through the second set of cooling passages 140 into the first side collection plenum 126 when cooling turbine shroud 100.

As shown in FIG. 4, each of the second set of cooling passages 140 may also include an intermediate portion 148. Intermediate portion 148 may fluidly couple inlet portion 142 and outlet portion 146 of the second set of cooling passages 140. That is, intermediate portion 148 may be formed and/or extend within body 106 of turbine shroud 100 between inlet portion 142 and outlet portion 146 to fluidly couple inlet portion 142 and outlet portion 146. Additionally, intermediate portion 148 may extend within and/or span across body 106 between second side 118 and first side 112. In the non-limiting example shown in FIG. 4, intermediate portion 148 of each of the second set of cooling passages 140 may be substantially linear when extending between inlet portion 142 and outlet portion 146. Additionally, and as shown in FIG. 4, when moving from forward end 108 to aft end 110 of body 106, the cooling passages for the first set of cooling passages 130 and the second set of cooling passages 140 may alternate. For example, intermediate portion 148 for each of the second set of cooling passages 140 may be positioned between and/or may be positioned adjacent intermediate portion 138 for two cooling passages of the first set of cooling passages 130.

Although discussed herein as including hook-shaped portion 134, 144, it is understood that cooling passages 130, 140 may be formed in turbine shroud 100 without hook-shaped portion 134, 144. That is, the inclusions of hook-shaped portion 134, 144 in cooling passages 130, 140 may be illustrative. As such, cooling passages 130, 140 may be substantially linear and/or may not include hook-shaped portion 134, 144.

Also shown in FIGS. 4-6, turbine shroud 100 may also include at least one exhaust hole. More specifically, turbine shroud 100 may include a first exhaust hole 150, and a second exhaust hole 152. First exhaust hole 150 may be in fluid communication with first side collection plenum 126. More specifically, first exhaust hole 150 may be in fluid communication with and may extend axially from first side collection plenum 126 of turbine shroud 100. In the non-limiting example shown in FIGS. 4 and 5, first exhaust hole 150 may extend through body 106, from first side collection plenum 126 to and/or through aft end 110 of body 106 for turbine shroud 100. In addition to being in fluid communication with first side collection plenum 126, first exhaust hole 150 may be in fluid communication with additional portions or areas within casing 36 of turbine 28 (see, FIG. 2). In a non-limiting example, first exhaust hole 150 may be in fluid communication with a space or area surrounding outer platform 42 of stator vanes 40 of turbine 28 (see, FIG. 2). During operation, and as discussed herein, first exhaust hole 150 may discharge cooling fluid from first side collection plenum 126, adjacent aft end 110 of turbine shroud 100, and into the space, area, or gap (G) formed between shroud 100 and outer platform 42 of stator vanes 40 (see, FIG. 2). The cooling fluid discharged from first side collection plenum 126 may purge the gap (G) between shroud 100 and outer platform 42 of stator vane 40 of combustion gases 26 (see, FIG. 2), which in turn may lower the temperature of the gap (G). Additionally, or alternatively, the cooling fluid discharged from first side collection plenum 126 may be discharged within and/or above the gap (G) to crossover to outer platform 42 of stator vane 40 and used as cooling and/or leakage for outer platform 42.

Second exhaust hole 152 may be in fluid communication with second side collection plenum 128. More specifically, second exhaust hole 152 may be in fluid communication with and may extend axially from second side collection plenum 128 of turbine shroud 100. In the non-limiting example shown in FIGS. 4 and 6, second exhaust hole 152 may extend through body 106, from second side collection plenum 128 to and/or through aft end 110 of body 106 for turbine shroud 100. In addition to being in fluid communication with second side collection plenum 128, second exhaust hole 152 may be in fluid communication with additional portions or areas within casing 36 of turbine 28 (see, FIG. 2), similar to first exhaust hole 150. In non-limiting examples, second exhaust hole 152 may be in fluid communication with a space or area surrounding outer platform 42 of stator vanes 40 of turbine 28 (see, FIG. 2).

First exhaust hole 150 and second exhaust hole 152 of turbine shroud 100 may be sized and/or include a geometry to ensure that first side collection plenum 126 and second side collection plenum 128 maintains a desired, internal pressure. By maintaining the desired, internal pressure within first side collection plenum 126 and second side collection plenum 128 the cooling fluid provided by cooling passages 130, 140 may continuously flow through first side collection plenum 126 and second side collection plenum 128, and exhaust from first exhaust hole 150 and second exhaust hole 152, respectively, as discussed herein. As shown in the non-limiting example of FIGS. 5 and 6, first exhaust hole 150 and second exhaust hole 152 may include a predetermined diameter (Dia) that may affect or determine the internal pressure (e.g., desired pressure) for first side collection plenum 126 and second side collection plenum 128, respectively. In other non-limiting examples (see, FIGS. 9 and 10) first exhaust hole 150 and second exhaust hole 152 may include a tapered geometry and/or may be tapered to affect or determine the internal pressure for first side collection plenum 126 and second side collection plenum 128, respectively. As discussed herein, providing first side collection plenum 126 and second side collection plenum 128 with the desired, internal pressure may allow better control over coolant/leakage flows and back flow margins to prevent hot gas path ingestion. Although shown as only including a single exhaust hole 150, 152 in fluid communication with each of first side collection plenum 126 and second side collection plenum 128, it is understood that first side collection plenum 126 and/or second side collection plenum 128 may include a plurality of exhaust holes (e.g., FIG. 7).

During operation of gas turbine system 10 (see, FIG. 1), a cooling fluid may flow through body 106 to cool turbine shroud 100. More specifically, as turbine shroud 100 is exposed to combustion gases 26 flowing through the hot gas flow path of turbine 28 (see, FIG. 2) during operation of gas turbine system 10, cooling fluid may be provided to and/or may flow through the first set of cooling passages 130 and the second set of cooling passages 140 formed and/or extending through body 106 to cool turbine shroud 100. In a non-limiting example shown in FIGS. 4-6, the cooling fluid may first flow from cooling chamber 122 to the first set of cooling passages 130 via inlet portions 132 formed and/or extending through outer surface 120 of body 106. The cooling fluid may initially enter inlet portion 132 of the first set of cooling passages 130, and flow through hook-shaped section 134. Once the cooling fluid has flowed through hook-shaped section 134 of inlet portion 132 for each of the first set of cooling passages 130, the cooling fluid may flow from first side 112 to second side 118 via intermediate portion 138 of first set of cooling passages 130. From intermediate portion 138, the cooling fluid may flow through outlet portion 136 and subsequently flow into and/or be discharged to second side collection plenum 128 via outlet portion 136. As discussed herein, outlet portion 136 of first set of cooling passages 130 may be in fluid communication and/or may be fluidly coupled to second side collection plenum 128 to provide the cooling fluid from first set of cooling passages 130 to second side collection plenum 128.

Once the cooling fluid has flowed into second side collection plenum 128 via first set of cooling passages 130, the cooling fluid may flow through and/or be exhausted from second exhaust hole 152. More specifically, the cooling fluid received in second side collection plenum 128 may flow axially downstream and/or may flow toward aft end 110 of turbine shroud 100. The cooling fluid may then flow through and/or be exhausted from second side collection plenum 128 via second exhaust hole 152 formed through aft end 110. In a non-limiting example, second exhaust hole 152 may be in fluid communication with the space, area, or gap (G) formed between shroud 100 and outer platform 42 of stator vanes 40 (see, FIG. 2). As such, when the cooling fluid is exhausted from turbine shroud 100, second exhaust hole 152 may direct the cooling fluid toward outer platform 42 of stator vanes 40 of turbine 28. The cooling fluid flowing from turbine shroud 100 toward outer platform 42 may purge the gap (G) between shroud 100 and outer platform 42 of stator vane 40 of combustion gases 26 (see, FIG. 2), which in turn may lower the temperature of the gap (G). Additionally, or alternatively, the cooling fluid discharged from turbine shroud 100 may be discharged within and/or above the gap (G) to crossover to outer platform 42 of stator vane 40 and used as cooling and/or leakage for outer platform 42.

Simultaneously, the cooling fluid flowing through the second set of cooling passages 140 may follow a similar flow path with distinct portions and/or features of turbine shroud 100. That is, during operation of gas turbine system 10, and simultaneous to the cooling fluid flowing through first set of cooling passages 140, second side collection plenum 128, and second exhaust hole 152, cooling fluid may flow through second set of cooling passages 140, first side collection plenum 126, and first exhaust hole 150. For example, the cooling fluid may first flow from cooling chamber 122 to the second set of cooling passages 140 via inlet portions 142 formed and/or extending through outer surface 120 of body 106. The cooling fluid may initially enter inlet portion 142 of the second set of cooling passages 140, and flow through hook-shaped section 144. Once the cooling fluid has flowed through hook-shaped section 144 of inlet portion 142 for each of the second set of cooling passages 140, the cooling fluid may flow from second side 118 to first side 112 via intermediate portion 148. From intermediate portion 148, the cooling fluid may flow through outlet portion 146 and subsequently flow into and/or be discharged to first side collection plenum 126.

Cooling fluids entering first side collection plenum 126 via the second set of cooling passages 140 may flow through and/or be exhausted from first exhaust hole 150. More specifically, the cooling fluid received in first side collection plenum 126 may flow axially downstream and/or may flow toward aft end 110 of turbine shroud 100, and may subsequently flow through and/or be exhausted from first side collection plenum 126 via first exhaust hole 150. Similar to second exhaust hole 152, first exhaust hole 150 of turbine shroud 100 may be in fluid communication with a space, area, or gap (G) formed between shroud 100 and outer platform 42 of stator vanes 40 (see, FIG. 2). The cooling fluid discharged from first exhaust hole 150 may purge the gap (G) between shroud 100 and outer platform 42 of stator vane 40 of combustion gases 26 (see, FIG. 2), which in turn may lower the temperature of the gap (G). Additionally, or alternatively, the cooling fluid discharged from first exhaust hole 150 may be discharged within and/or above the gap (G) to crossover to outer platform 42 of stator vane 40 and used as cooling and/or leakage for outer platform 42.

Figure 7:
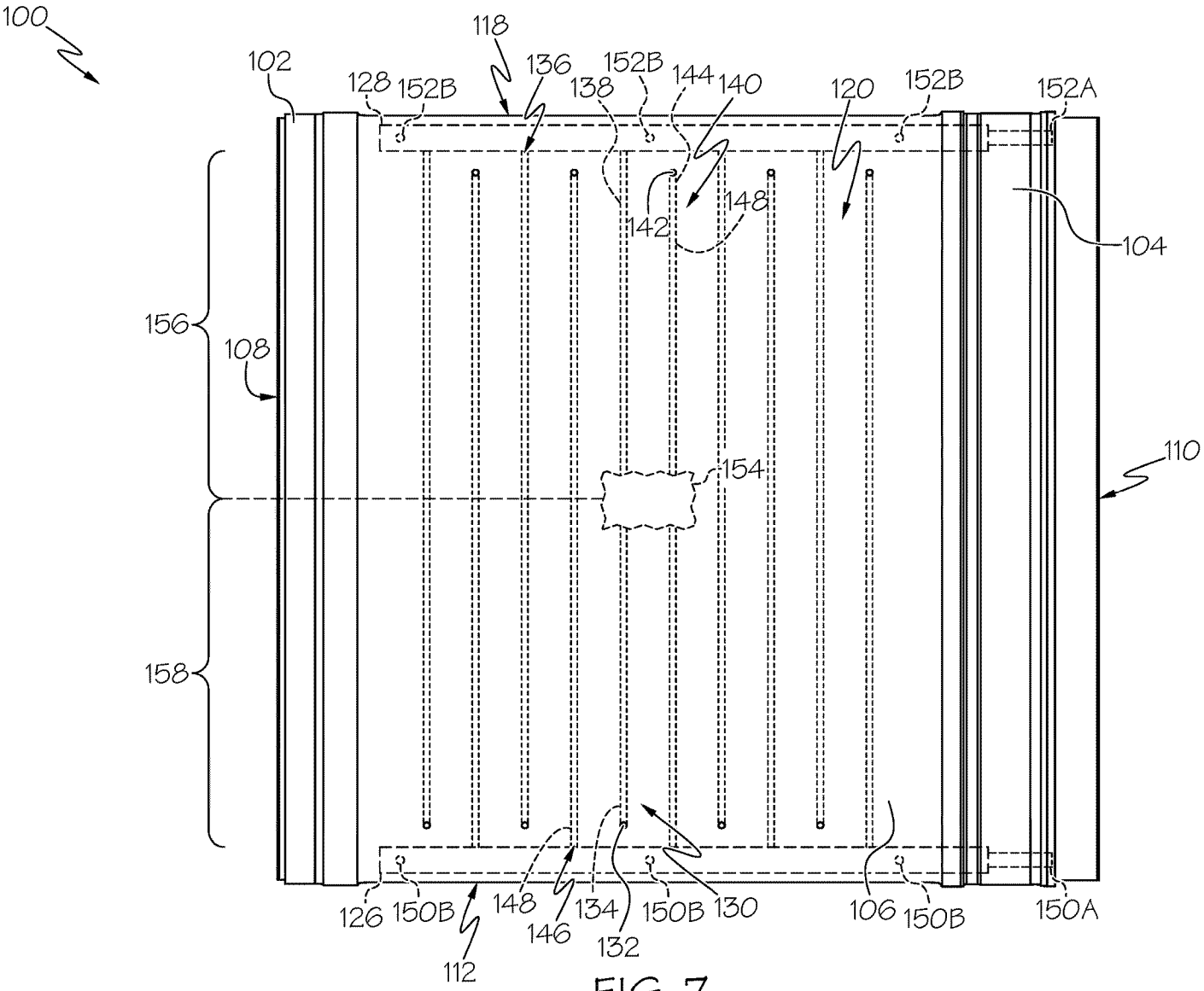
FIG. 7 shows a top view of a turbine shroud including a damage aperture and damaged cooling passages, according to additional embodiments of the disclosure.

FIG. 7 shows a top view of the non-limiting example of turbine shroud 100 shown in FIGS. 4-6. In the non-limiting example shown in FIG. 7, cooling passages 130, 140 formed within turbine shroud 100 may include a distinct configuration. Specifically, first set of cooling passages 130 and second set of cooling passages 140 may be substantially linear in shape and/or geometry. As shown, first set of cooling passages 130 may only include inlet portion 132, outlet portion 136, and intermediate portion 138 extending between and fluidly coupling inlet portion 132 and outlet portion 136. Additionally, second set of cooling passages 140 may only include inlet portion 142, outlet portion 146, and intermediate portion 148 extending between and fluidly coupling inlet portion 142 and outlet portion 146.

Also as shown in FIG. 7, each of first side collection plenum 126 and second side collection plenum 128 may include a plurality of exhaust holes 150A, 150B, 152A, 152B. For example, first side collection plenum 126 may include first exhaust hole 150A formed through aft end 110, and second side collection plenum 128 may include second exhaust hole 152A formed through aft end 110, as similarly discussed herein with respect to FIGS. 4-6. Additionally, first side collection plenum 126 may also include at least one first exhaust hole 150B in fluid communication with first side collection plenum 126. In the non-limiting example shown in FIG. 7, first exhaust hole(s) 150B may extend through body 106, and more specifically through inner surface 124 of shroud 100. In addition to being in fluid communication with first side collection plenum 126, first exhaust hole(s) 150B may be in fluid communication with the hot gas flow path (FP) (see, FIG. 2) to discharge the cooling fluid axially into the hot gas flow path (FP) and/or axially from body 106/inner surface 124 of shroud 100. Similar to first side collection plenum 126, second side collection plenum 128 may include at least one second exhaust hole 152B in fluid communication with second side collection plenum 128, and extending through inner surface 124 of body 106 for shroud 100. Second exhaust hole(s) 152B may be in fluid communication with the hot gas flow path (FP) (see, FIG. 2) to discharge the cooling fluid from second side collection plenum 128 axially to the hot gas flow path (FP) and/or axially from body 106/inner surface 124 of shroud 100.

Additionally in the non-limiting example shown in FIG. 7, at least one cooling passage for each of first set of cooling passages 130 and second set of cooling passages 140 may be shown as damaged and/or broken. Cooling passages for each of first set of cooling passages 130 and second set of cooling passages 140 may become damaged as a result of a component outage within turbine 28 (see, FIG. 2) and/or due to oxidation erosion on inner surface 124 of turbine shroud 100. In the non-limiting example shown in FIG. 7, a single intermediate portion 138, 148 for each of first set of cooling passages 130 and second set of cooling passages 140 may be damaged and/or broken, such that the damaged intermediate portion 138, 148 may no longer fluidly couple the respective inlet portions 132, 142 and outlet portion 136, 146. Rather in the non-limiting example, each of the damaged intermediate portion 138, 148 may be in direct fluid communication with the flow path (FP) of turbine 28 (see, FIGS. 2, 3, 5) via damage aperture 154 formed through inner surface 124 of turbine shroud 100. In the non-limiting example where turbine shroud 100, and more specifically a portion cooling passages of first set of cooling passages 130 and second set of cooling passages 140, becomes damaged, the at least one plenum of turbine shroud 100 may provide cooling fluid to the damaged cooling passages. For example, and as shown in FIG. 7, where intermediate portion 138 of a cooling passage of first set of cooling passages 130 becomes damaged, second side collection plenum 128 may provide cooling fluid to the section 156 of intermediate portion 138 that remains in fluid communication with second side collection plenum 128 via outlet 136. More specifically, cooling fluid previous provided to second side collection plenum 128 via undamaged cooling passages of first set of cooling passages 130 may be reused or recirculated within turbine shroud 100 to section 156 of intermediate portion 138 via outlet portion 136. The cooling fluid may flow through section 156 of intermediate portion 138 toward, and/or may be exhausted from damage aperture 154 into the flow path (FP) of turbine 28 (see, FIG. 2).

Similarly, and as shown in FIG. 7, where intermediate portion 148 of a cooling passage of second set of cooling passages 140 becomes damaged and/or is in fluid communication with damage aperture 154, first side collection plenum 126 may provide cooling fluid to the section 158 of intermediate portion 148 that remains in fluid communication with first side collection plenum 126 via outlet 146. That is, cooling fluid previous provided to first side collection plenum 126 via undamaged cooling passages of second set of cooling passages 140 may be reused or recirculated within turbine shroud 100 to section 156 of intermediate portion 148 via outlet portion 146. The cooling fluid may flow through section 156 of intermediate portion 148 toward, and/or may be exhausted from damage aperture 154 into the flow path (FP) of turbine 28 (see, FIG. 2).

As discussed herein, first side collection plenum 126 and second side collection plenum 128 may include a desired pressure as determined and/or affect by first exhaust hole 150 and second exhaust hole 152, respectively. The desired pressure within first side collection plenum 126 and second side collection plenum 128 may also allow the cooling fluid to be reused and/or recirculated through damaged cooling passages of turbine shroud 100, as discussed herein. Additionally, where the cooling fluid is being reused and/or recirculated through damaged cooling passages of turbine shroud 100, the pressure of the recirculated cooling fluid flowing through the damaged cooling passages of turbine shroud 100 may prevent combustion gases 26 flowing through turbine 28 from entering the turbine shroud (e.g., via damage aperture 154).

Figure 8:
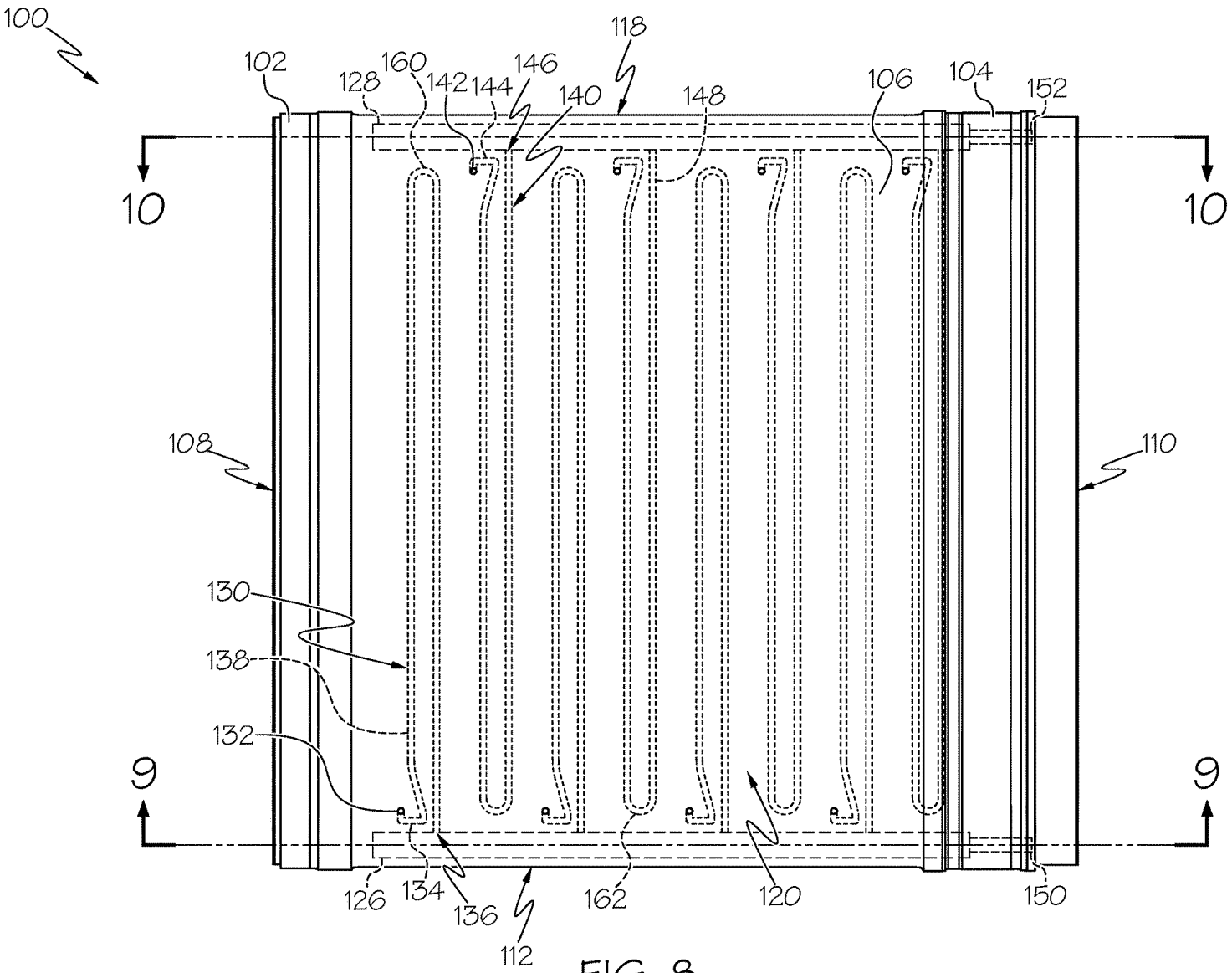
FIG. 8 shows a top view of the turbine shroud of FIG. 3, according to embodiments of the disclosure.
Figure 9:
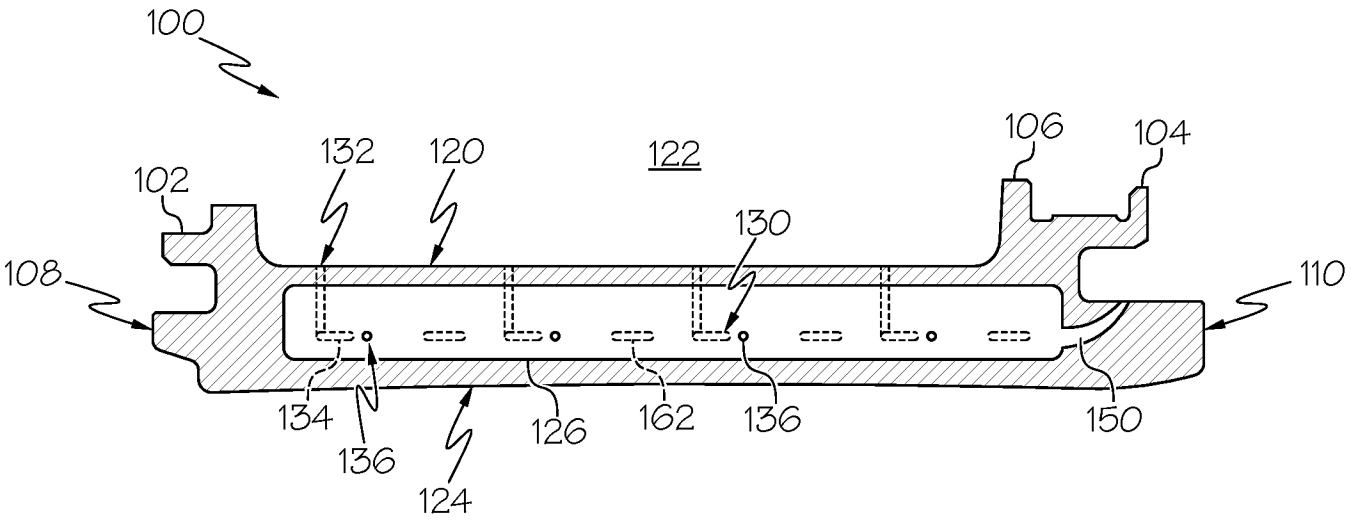
FIG. 9 shows a cross-sectional side view of the turbine shroud taken along line 9-9 in FIG. 8, according to additional embodiments of the disclosure.
Figure 10:
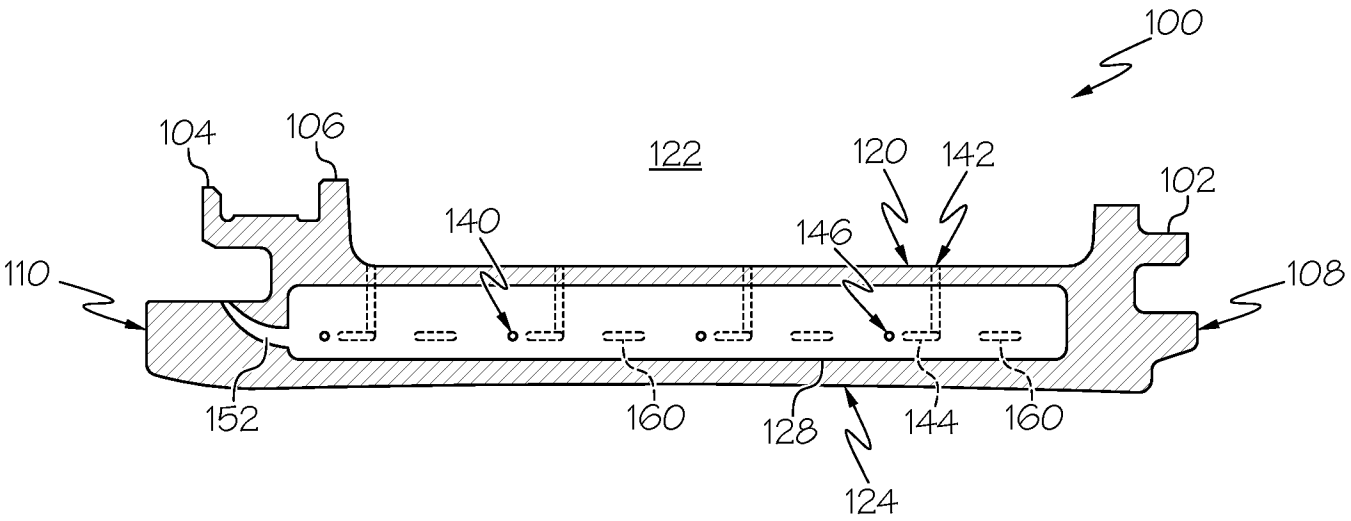
FIG. 10 shows a cross-sectional side view of the turbine shroud taken along line 10-10 in FIG. 8, according to additional embodiments of the disclosure.

FIGS. 8-10 show various views of another non-limiting example of turbine shroud 100 of turbine 28 for gas turbine system 10 of FIG. 1. Specifically, FIG. 8 shows a top view of turbine shroud 100, FIG. 9 shows a cross-sectional side view of turbine shroud 100 taken along line 9-9 in FIG. 8, and FIG. 10 shows a cross-sectional side view of turbine shroud 100 taken along line 10-10 in FIG. 8. It is understood that similarly numbered and/or named components may function in a substantially similar fashion. Redundant explanation of these components has been omitted for clarity.

As shown in FIGS. 8-10 turbine shroud 100 may include first set of cooling passages 130 and second set of cooling passages 140 extending within body 106. In the non-limiting example, first set of cooling passages 130 (shown in phantom in FIG. 8) of turbine shroud 100 may extend within body 106 between and/or from near first side 112 to near second side 118, and back to near first side 112. More specifically, inlet portion 132, including hook-shaped section 134, and outlet portion 136 may be positioned and/or formed adjacent first side 112 of body 106 for turbine shroud 100. As such, inlet portion 132 and outlet portion 136 for each of the first set of cooling passages 130 may both be positioned and/or formed adjacent first side collection plenum 126. In the non-limiting example, first side collection plenum 126 may be positioned and/or formed within body 106 between first side 112 of body 106 and inlet portion 132 and outlet portion 136, respectively, for each of the first set of cooling passages 130. Additionally in the non-limiting example shown in FIGS. 8 and 9, outlet portion 136 for each of the first set of cooling passages 130 may be in fluid communication with first side collection plenum 126. As discussed herein, outlet portion 136 for the first set of cooling passages 130 may be in fluid communication with first side collection plenum 126 to provide or expel the cooling fluid flowing through the first set of cooling passages 130 into the first side collection plenum 126.

Intermediate portion 138 may extend within body 106 between and may fluid couple inlet portion 132 and outlet portion 136, as discussed herein. To fluidly couple inlet portion 132 and outlet portion 136 in the non-limiting example shown in FIG. 8, intermediate portion 138 may include a turn section 160. Turn section 160 of intermediate portion 138 for each of the first set of cooling passages 130 may be positioned and/or formed adjacent second side 118 and/or second side collection plenum 128. Second side collection plenum 128 may be positioned and/or formed between second side 118 of body 106 and turn section 160. As such, and as shown the non-limiting example of FIG. 8, intermediate portion 138 may extend from inlet portion 132 toward second side 118. Turn section 160 of intermediate portion 138 may reverse the direction of intermediate portion 138 adjacent second side 118, and intermediate portion 138 may extend from second side 118 to first side 112 to be fluidly coupled with outlet portion 136 in fluid communication with first side collection plenum 126.

The non-limiting example shown in FIGS. 8-10 may also include second set of cooling passages 140 (shown in phantom in FIG. 8) of turbine shroud 100 extending within body 106 between and/or from near second side 118 to near first side 112, and back to near second side 118. More specifically, inlet portion 142, including hook-shaped section 144, and outlet portion 146 may be positioned and/or formed adjacent second side 118 of body 106 for turbine shroud 100. As such, inlet portion 142 and outlet portion 146 for each of the second set of cooling passages 140 may both be positioned and/or formed adjacent second side collection plenum 128. In the non-limiting example, second side collection plenum 128 may be positioned and/or formed within body 106 between second side 118 of body 106 and inlet portion 142 and outlet portion 146, respectively, for each of the second set of cooling passages 140. Additionally in the non-limiting example shown in FIGS. 8 and 10, outlet portion 146 for each of the second set of cooling passages 140 may be in fluid communication with second side collection plenum 128. As discussed herein, outlet portion 146 for the second set of cooling passages 140 may be in fluid communication with second side collection plenum 128 to provide or expel the cooling fluid flowing through the second set of cooling passages 140 into the second side collection plenum 128.

Intermediate portion 148 may extend within body 106 between and may fluid couple inlet portion 142 and outlet portion 146, as discussed herein. In the non-limiting example shown in FIG. 8, and similar to intermediate portion 138, intermediate portion 148 may include a turn section 162. Turn section 162 of intermediate portion 148 for each of the second set of cooling passages 140 may be positioned and/or formed adjacent first side 112 and/or first side collection plenum 126. First side collection plenum 126 may be positioned and/or formed between first side 112 of body 106 and turn section 162. As such, and as shown the non-limiting example of FIG. 8, intermediate portion 148 may extend from inlet portion 142 toward first side 112. Turn section 162 of intermediate portion 148 may reverse the direction of intermediate portion 148 adjacent first side 112, and intermediate portion 148 may extend from first side 112 to second side 118 to be fluidly coupled with outlet portion 146 in fluid communication with second side collection plenum 128.

Additionally in the non-limiting example shown in FIGS. 9 and 10, and distinct from the non-limiting example discussed herein with respect to FIGS. 4-6, first exhaust hole 150 and second exhaust hole 152 of turbine shroud 100 may include a tapered geometry and/or may be tapered to affect or determine the internal pressure for first side collection plenum 126 and second side collection plenum 128, respectively. That is, first exhaust hole 150 in fluid communication with first side collection plenum 126, and extending through aft end 110, as well as second exhaust hole 152 in fluid communication with second side collection plenum 128, and extending through aft end 110, may be substantially tapered. As discussed herein, tapering first exhaust hole 150 and second exhaust hole 152 may ensure that first side collection plenum 126 and second side collection plenum 128 maintains a desired, internal pressure, and/or may determine the internal pressure for first side collection plenum 126 and second side collection plenum 128, respectively.

Figure 11:
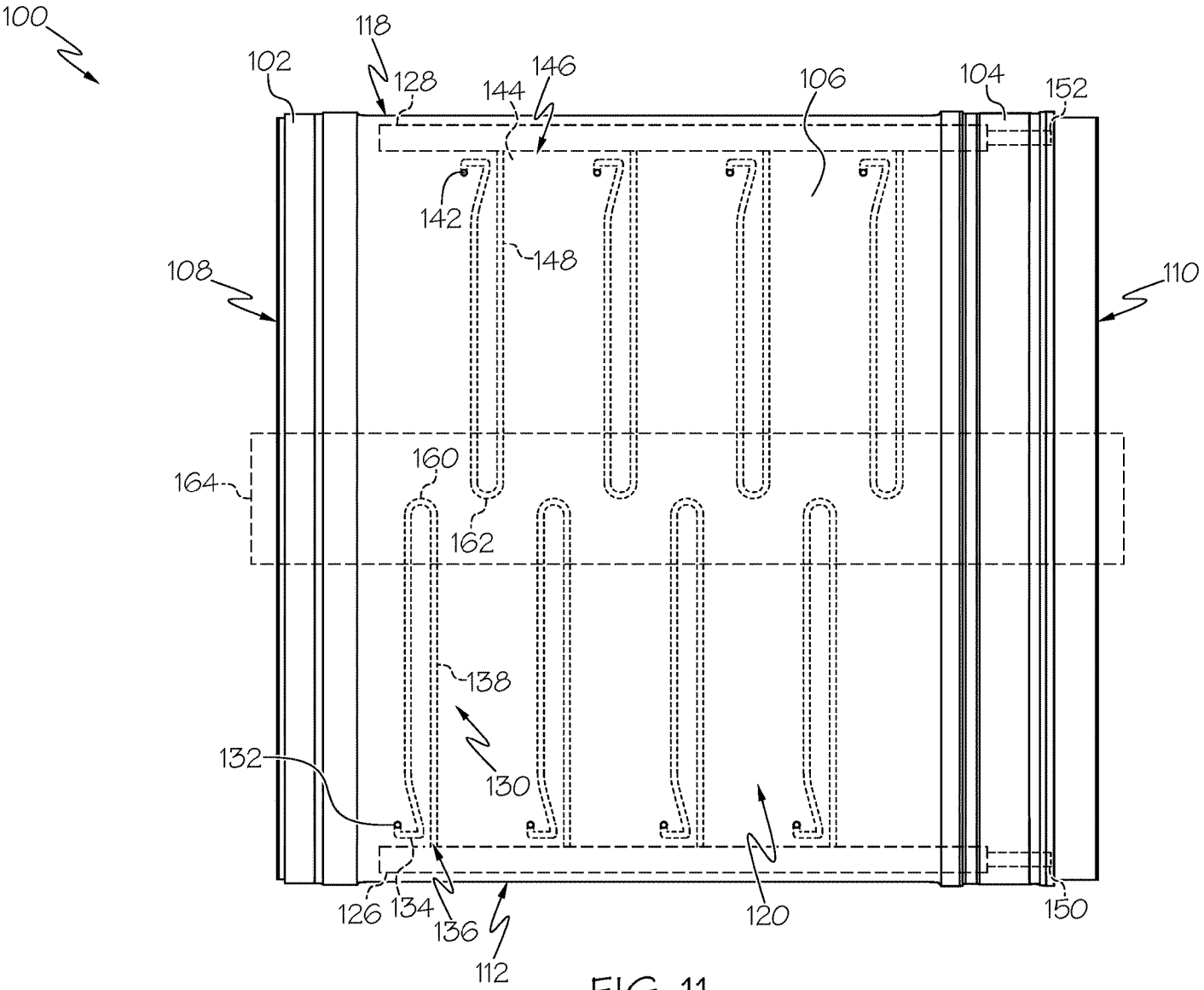
FIG. 11 shows a top view of the turbine shroud of FIG. 3, according to further embodiments of the disclosure.

FIG. 11 shows a top view of another non-limiting example of turbine shroud 100. Each of the cooling passages for first set of cooling passages 130 and second set of cooling passages 140 shown in FIG. 11 may include similar features (e.g., turn section 160, 162) as those discussed herein with respect to FIGS. 8-10. However, and distinct from the non-limiting example discussed herein with respect to FIGS. 8-10, portions of first set of cooling passages 130 and second set of cooling passages 140 shown in FIG. 11 may not extend within body 106 completely between first side 112 and second side 118. For example, first set of cooling passages 130 (shown in phantom in FIG. 11) of turbine shroud 100 may extend within body 106 between and/or from near first side 112 to a central region 164 of body 106, and back to near first side 112 from central region 164. Turn section 160 of intermediate portion 138 for each of the first set of cooling passages 130 may be positioned, formed, and/or extend within central region 164 of body 106. As such in the non-limiting example, intermediate portion 138 may extend from inlet portion 132 toward second side 118. Turn section 160 of intermediate portion 138 may reverse the direction of intermediate portion 138 at central region 164 of body 106, and intermediate portion 138 may extend from central region 164 back toward first side 112 to be fluidly coupled with outlet portion 136 in fluid communication with first side collection plenum 126.

Additionally in the non-limiting example shown in FIG. 11, second set of cooling passages 140 (shown in phantom in FIG. 11) of turbine shroud 100 may extend within body 106 between and/or from near second side 118 to central region 164 of body 106, and back to near second side 118 from central region 164. Turn section 162 of intermediate portion 148 for each of the second set of cooling passages 140 may be positioned, formed, and/or extend within central region 164 of body 106. Turn section 162 of intermediate portion 148 may also extend within body 106 adjacent to turn section 160 of intermediation portion 138 for first set of cooling passages 130. In the non-limiting example, intermediate portion 148 may extend from inlet portion 142 toward first side 112. Turn section 162 of intermediate portion 148 may reverse the direction of intermediate portion 148 at central region 164 of body 106, and intermediate portion 148 may extend from central region 164 back toward second side 118 to be fluidly coupled with outlet portion 146 in fluid communication with second side collection plenum 128.

Figure 12:
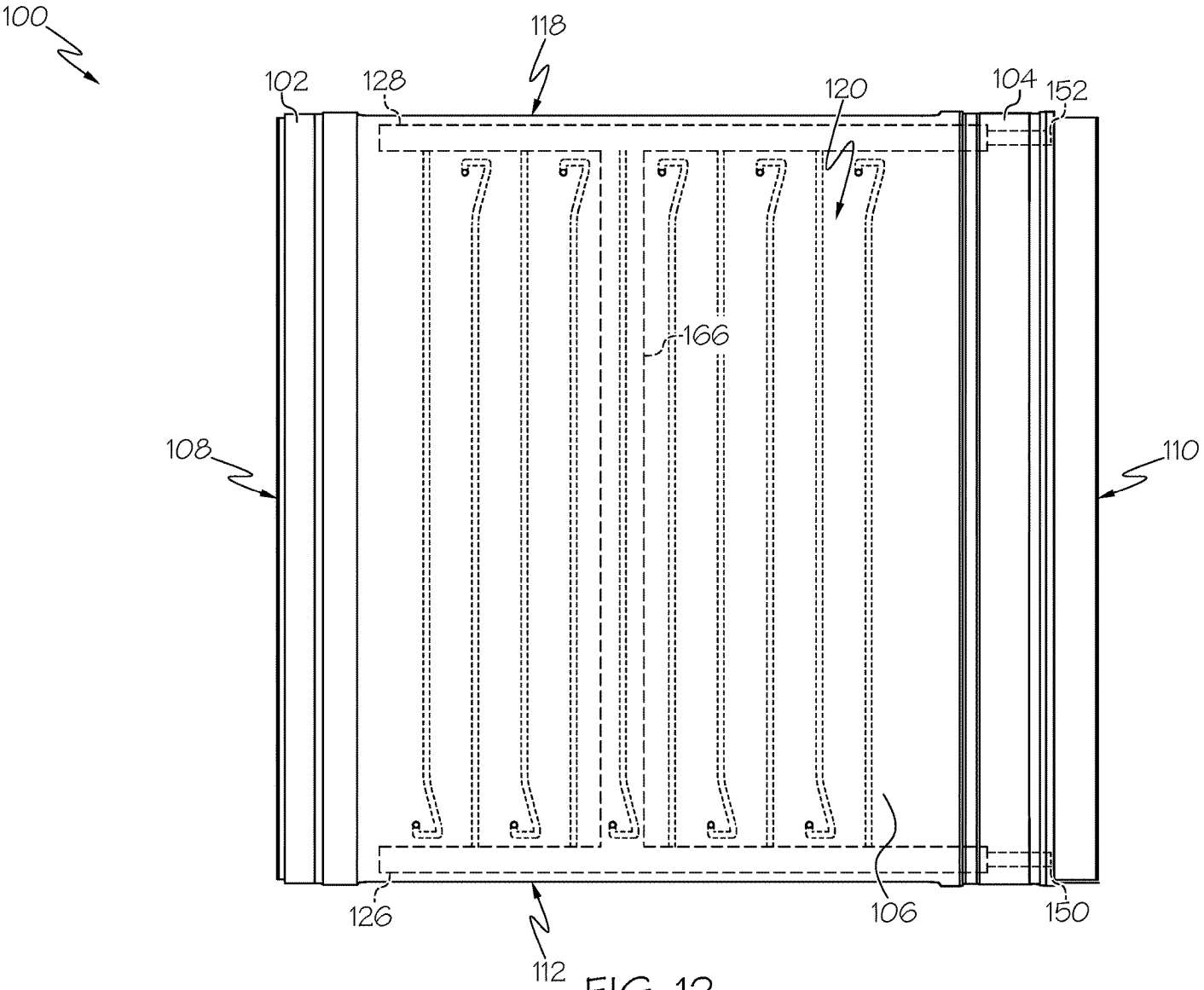
FIGS. 12-14 shows top views of the turbine shroud of FIG. 3 including at least one coupling conduit, according to embodiments of the disclosure.
Figure 13:
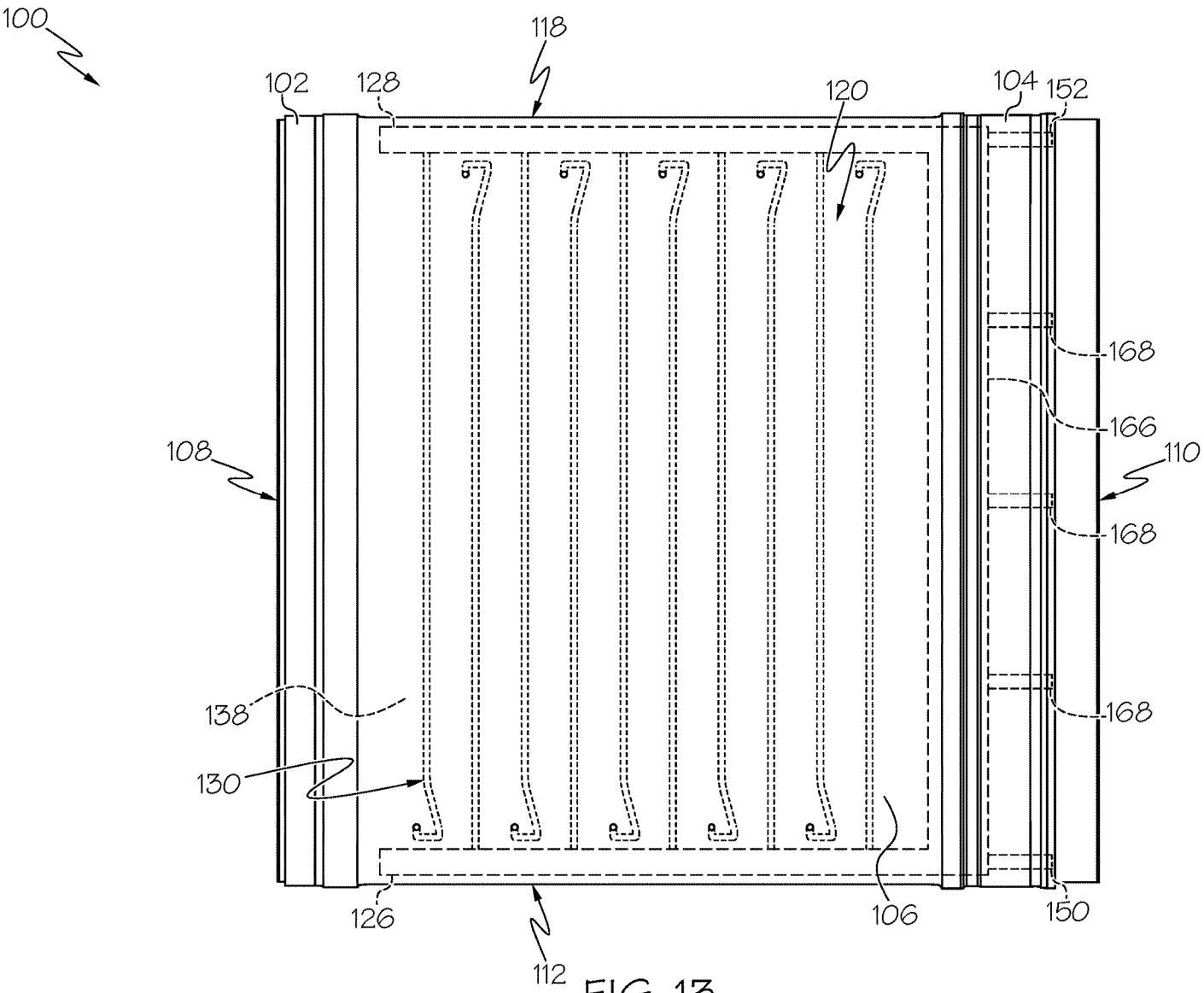
Figure 14:
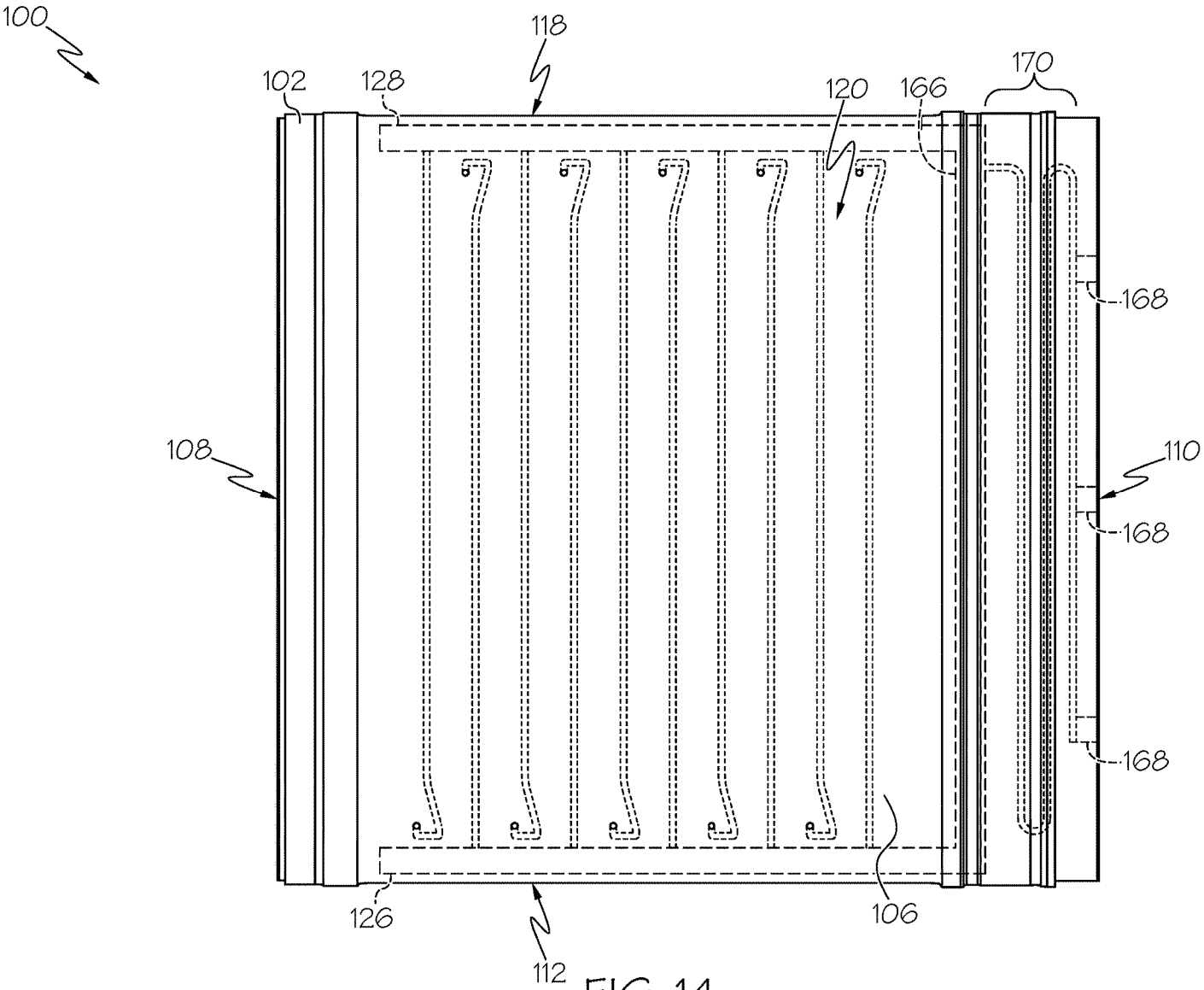

FIGS. 12-14 show various views of additional non-limiting example of turbine shroud 100 of turbine 28 for gas turbine system 10 of FIG. 1. The non-limiting examples of turbine shroud 100 shown in FIGS. 12-14 may include a coupling conduit 166. Coupling conduit 166 may extend within body 106 of turbine shroud 100. More specifically, coupling conduit 166 may extend within body 106 between first side 112 and second side 118, and/or between first side collection plenum 126 and second side collection plenum 128, respectively. In the non-limiting example shown in FIGS. 12-14, coupling conduit 166 may extend within body 106 radially above and/or radially outward from a select portion of the cooling passages for the first set of cooling passages 130 and the second set of cooling passages 140, respectively. In this non-limiting example, coupling conduit 166 may be positioned adjacent outer surface 120 of body 106, and/or may be positioned between outer surface 120 of body 106 and the select portion of the cooling passages for the first set of cooling passages 130 and the second set of cooling passages 140. In another non-limiting example (not shown), coupling conduit 166 may extend within body 106 radially below and/or radially outward from a select portion of the cooling passages for the first set of cooling passages 130 and the second set of cooling passages 140, respectively. In this non-limiting example, coupling conduit 166 may be positioned adjacent inner surface 124 of body 106, and/or may be positioned between inner surface 124 of body 106 and the select portion of the cooling passages for the first set of cooling passages 130 and the second set of cooling passages 140.

Additionally, and as shown in the non-limiting examples, coupling conduit 166 may be in fluid communication with and/or may fluidly couple first side collection plenum 126 to second side collection plenum 128 extending within body 106. As a result of being fluidly coupled, first side collection plenum 126 to second side collection plenum 128 may exchange cooling fluid included therein before exhausting the cooling fluid from the respective first exhaust hole 150 and second exhaust hole 152. In the non-limiting example shown in FIG. 12, coupling conduit 166 may extend within body 106 between first side collection plenum 126 and second side collection plenum 128, and be positioned between forward end 108 and aft end 110 of body 106. First side collection plenum 126 and second side collection plenum 128 may exchange cooling fluids via coupling conduit 166. As such, the cooling fluid is exhausted from the respective first exhaust hole 150 and second exhaust hole 152 may include cooling fluid from both first side collection plenum 126 and second side collection plenum 128.

In the non-limiting example shown in FIG. 13, coupling conduit 166 may extend within body 106 between first side collection plenum 126 and second side collection plenum 128, and may be formed substantially adjacent aft end 110 of body 106. In this non-limiting example, coupling conduit 166 may be positioned axially upstream of first exhaust hole 150 and second exhaust hole 152 for first side collection plenum 126 and second side collection plenum 128, respectively. Before the cooling fluid is exhausted from the respective first exhaust hole 150 and second exhaust hole 152, first side collection plenum 126 and/or second side collection plenum 128 may exchange a portion of the cooling fluid via coupling conduit 166 extending adjacent aft end 110. Additionally, coupling conduit 166 receiving cooling fluid from first side collection plenum 126 and/or second side collection plenum 128 may also aid in the cooling of aft end 110 of body 106 for turbine shroud 100. Also as shown in the non-limiting example of FIG. 13, turbine shroud 100 may also include at least one auxiliary exhaust hole 168. Auxiliary exhaust hole(s) 168 may be formed through aft end 110 of body 106, and may be in fluid communication with coupling conduit 166. In this non-limiting example, auxiliary exhaust hole(s) 168 extending through aft end 110 from coupling conduit 166 may be in fluid communication with the space, area, or gap (G) formed between shroud 100 and outer platform 42 of stator vanes 40 (see, FIG. 2). As such, and similar to first exhaust hole 150 and second exhaust hole 152, auxiliary exhaust hole(s) 168 may exhaust the cooling fluid to purge the gap (G) between shroud 100 and outer platform 42 of stator vane 40 of combustion gases 26 (see, FIG. 2), which in turn may lower the temperature of the gap (G). Additionally, or alternatively, the cooling fluid discharged from auxiliary exhaust hole(s) 168 may be discharged within and/or above the gap (G) to crossover to outer platform 42 of stator vane 40 and used as cooling and/or leakage for outer platform 42.

Similar to FIG. 13, the non-limiting example shown in FIG. 14 may include coupling conduit 166 in fluid communication with first side collection plenum 126 and second side collection plenum 128, and extending within body 106 adjacent aft end 110. Coupling conduit 166 may also be in fluid communication and/or fluidly coupled to a serpentine conduit 170. Serpentine conduit 170 may extend within body 106 adjacent aft end 110, axially downstream from coupling conduit 166. Additionally, and as shown in FIG. 14, serpentine conduit 170 may extend, serpentine, and/or include a plurality of turns that span between first side 112 and second side 118 of body 106. Serpentine conduit 170 extending within body 106 may include at least one auxiliary exhaust hole 168 extending through aft end 110 of body 106 for turbine shroud 100, and may exhaust the cooling fluid to space or area surrounding outer platform 42 of stator vanes 40 of turbine 28 (see, FIG. 2), as discussed herein. Serpentine conduit 170 formed in turbine shroud 100 may aid in the heat transfer and/or cooling of turbine shroud 100 during operation of gas turbine system 10, as discussed herein.

Although shown as being fluidly coupled to and/or in fluid communication with coupling conduit 166, it is understood that serpentine conduit 170 may be in fluid communication with and/or fluidly coupled to additional or distinct portions of turbine shroud 100. In another non-limiting example (not shown), serpentine conduit 170 may be fluidly coupled to first side collection plenum 126 and/or second side collection plenum 128.

Figure 15:
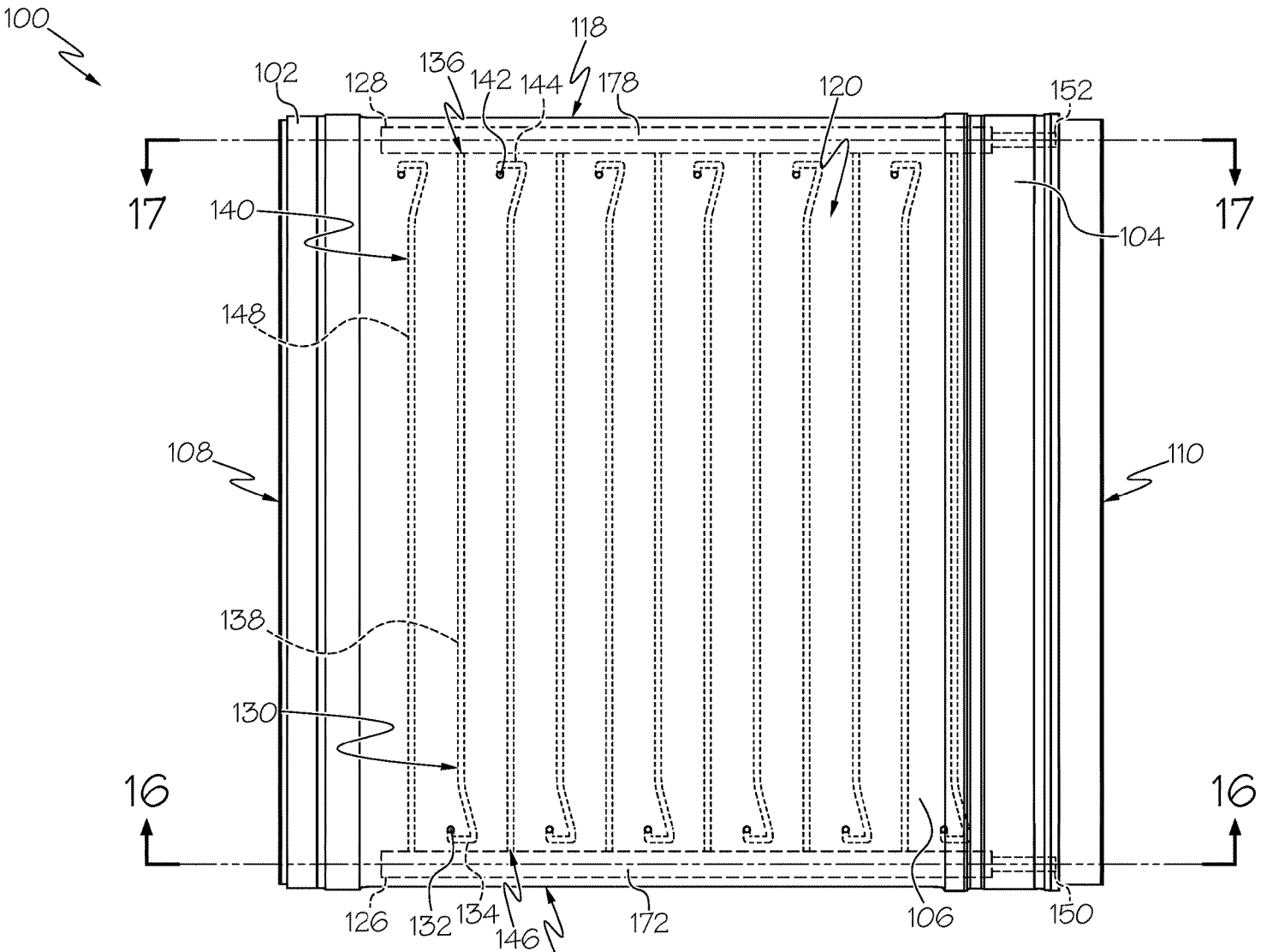
FIG. 15 shows a top view of the turbine shroud of FIG. 3 including walls formed in the collection plenums, according to embodiments of the disclosure.
Figure 16:
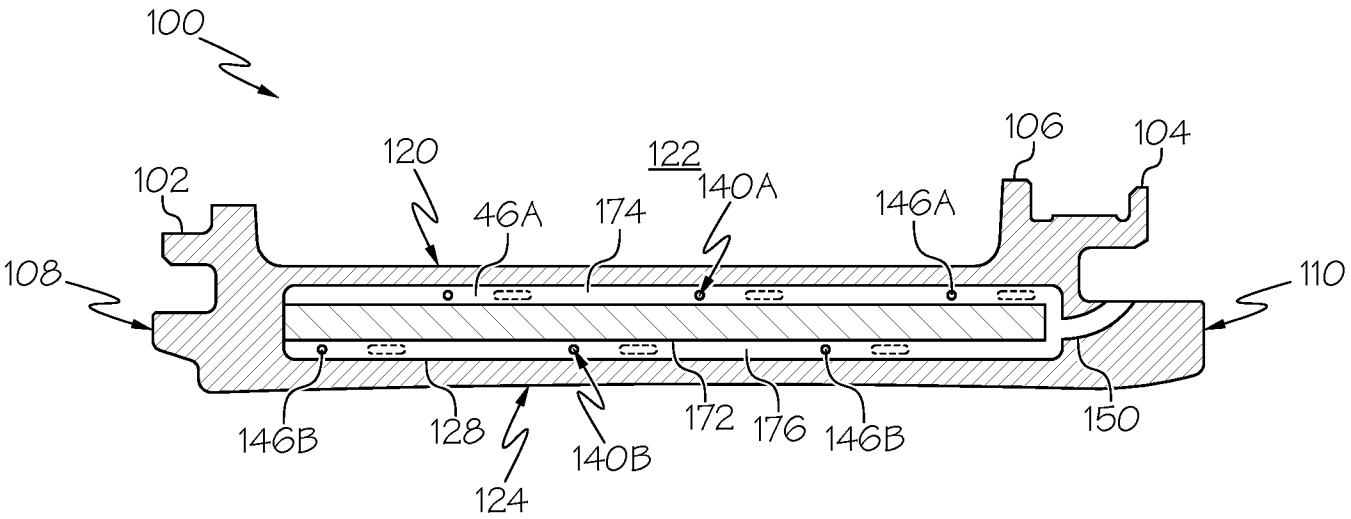
FIG. 16 shows a cross-sectional side view of the turbine shroud taken along line 16-16 in FIG. 15, according to embodiments of the disclosure.
Figure 17:
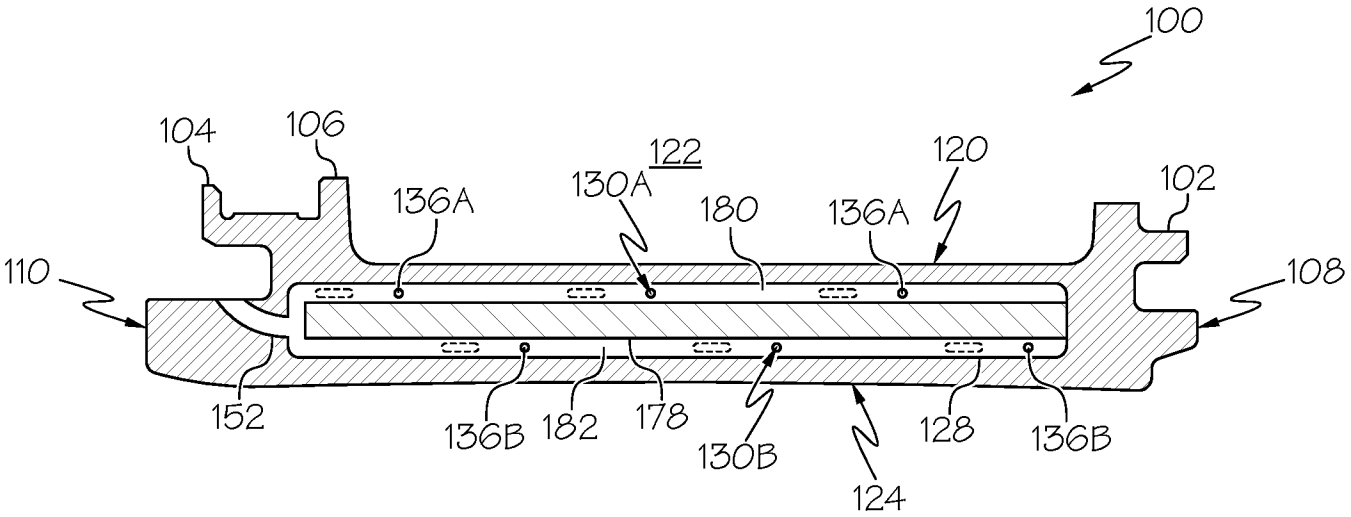
FIG. 17 shows a cross-sectional side view of the turbine shroud taken along line 17-17 in FIG. 15, according to embodiments of the disclosure.

FIGS. 15-17 show various views of another non-limiting example of turbine shroud 100 of turbine 28 for gas turbine system 10 of FIG. 1. Specifically, FIG. 15 shows a top view of turbine shroud 100, FIG. 16 shows a cross-sectional side view of turbine shroud 100 taken along line 16-16 in FIG. 15, and FIG. 17 shows a cross-sectional side view of turbine shroud 100 taken along line 17-17 in FIG. 15. It is understood that similarly numbered and/or named components may function in a substantially similar fashion. Redundant explanation of these components has been omitted for clarity.

The non-limiting example of turbine shroud 100 shown in FIGS. 15-17 may include additional features. For example, turbine shroud 100 may include a first wall 172 (shown in phantom in FIG. 15). First wall 172 may extend within first side collection plenum 126. In the non-limiting example shown in FIGS. 15 and 16, first wall 172 may extend within first side collection plenum 126 from near forward end 108 to near aft end 110 of body 106. Additionally, first wall 172 may extend within first side collection plenum 126 between and substantially parallel to outer surface 120 and inner surface 124 of body 106. In the non-limiting example, the formation of first wall within first side collection plenum 126 may substantially divide first side collection plenum 126 into a plurality of distinct sections including an outer section 174 and an inner section 176. Outer section 174 of first side collection plenum 126 may be formed and/or positioned between first wall 172 and outer surface 120 of body 106, and inner section 176 of first side collection plenum 126 may be formed and/or positioned between first wall 172 and inner surface 124 of body 106. Briefly turning to FIG. 16, first exhaust hole 150 may be in fluid communication with both outer section 174 and inner section 176 to receive and exhaust cooling fluid from both sections of first side collection plenum 126. In a non-limiting example where body 106 is formed as a unitary body, first wall 172 may be formed integral with body 106 of turbine shroud 100 using any suitable additive manufacturing process(es) and/or method.

The formation of first wall 172 within first side collection plenum 126 may also divide the cooling passages in turbine shroud 100 into distinct groups in order to supply or provide cooling fluid to the distinct sections 174, 176 of first side collection plenum 126. For example, the second set of cooling passages 140 may be divided into a first group 140A and a second group 140B. Turning to FIG. 16, and with continued reference to FIG. 15, first group 140A of the second set of cooling passages 140 may be in fluid communication with outer section 174 of first side collection plenum 126, and second group 140B of the second set of cooling passages 140 may be in fluid communication with inner section 176 of first side collection plenum 126. More specifically, outlet portion 146A of first group 140A of the second set of cooling passages 140A may be in fluid communication with and/or fluidly coupled to outer section 174 of first side collection plenum 126 to provide cooling fluid therein. Additionally, outlet portion 146B of second group 140B of the second set of cooling passages 140A may be in fluid communication with and/or fluidly coupled to inner section 176 to provide cooling fluid to inner section 176 only.

Additionally in the non-limiting example shown in FIGS. 15 and 17, turbine shroud 100 may also include a second wall 178 (shown in phantom in FIG. 15). Similar to first wall 172, second wall 178 may extend within second side collection plenum 128 from near forward end 108 to near aft end 110 of body 106, and may be substantially parallel to outer surface 120 and inner surface 124 of body 106. The formation of second wall 178 within second side collection plenum 128 may divide second side collection plenum 128 into a plurality of distinct sections including an outer section 180 and an inner section 182. Outer section 180 may be formed and/or positioned between second wall 178 and outer surface 120 of body 106, and inner section 182 may be formed and/or positioned between second wall 178 and inner surface 124 of body 106. Briefly turning to FIG. 17, and similar to first exhaust hole 150, second exhaust hole 152 may be in fluid communication with both outer section 180 and inner section 182 to receive and exhaust cooling fluid from both sections of second side collection plenum 128.

The formation of second wall 178 within second side collection plenum 128 may also divide the cooling passages in turbine shroud 100 into distinct groups in order to supply or provide cooling fluid to the distinct sections 180, 182 of second side collection plenum 128. Turning to FIG. 16, and with continued reference to FIG. 15, a first group 130A of the first set of cooling passages 130 may be in fluid communication with outer section 180 of second side collection plenum 128, and second group 130B of the first set of cooling passages 130 may be in fluid communication with inner section 182 of second side collection plenum 128. In the non-limiting example, outlet portion 136A of first group 130A of the first set of cooling passages 130A may be in fluid communication with and/or fluidly coupled to outer section 180 of second side collection plenum 128. Outlet portion 136B of second group 130B of the first set of cooling passages 130A may be in fluid communication with and/or fluidly coupled to inner section 182.

Although shown as rejoining and/or distinct sections 174, 176, 180, 182 both being fluidly connected to respective exhaust holes 150, 152, it is understood that distinct sections 174, 176, 180, 182 of turbine shroud 100 may include corresponding and separate exhaust holes. That is for example, outer section 174 and inner section 176 may not provide the cooling fluid flowing there-through to be exhausted from exhaust hole 150. Rather, each of outer section 174 and inner section 176 formed through turbine shroud 100 may be in fluid communication with distinct and separate exhaust holes formed through turbine shroud 100 to exhaust the cooling fluid flowing through outer section 174 and inner section 176 separately.

Figure 18:
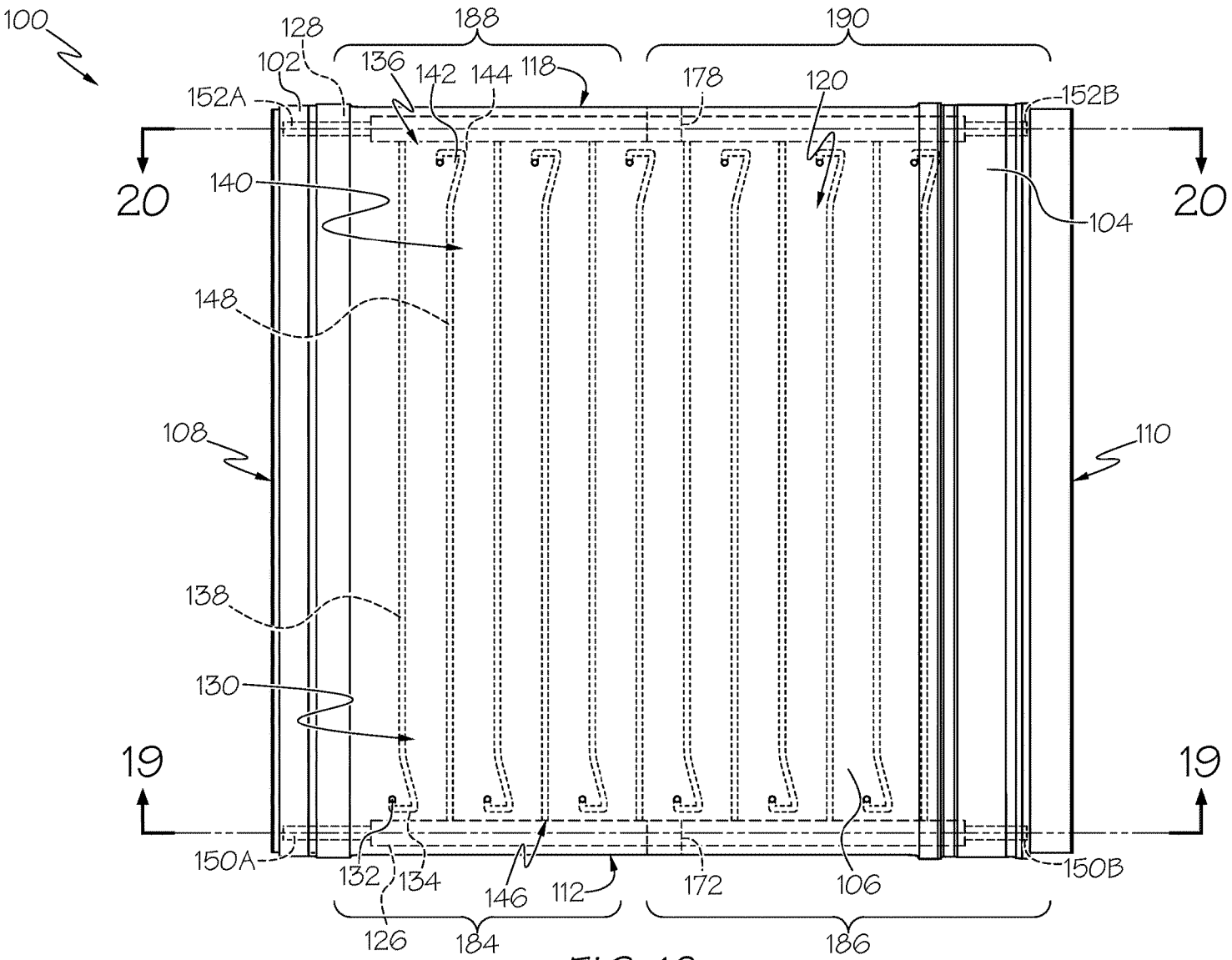
FIG. 18 shows a top view of the turbine shroud of FIG. 3 including walls formed in the collection plenums, according to additional embodiments of the disclosure.
Figure 19:
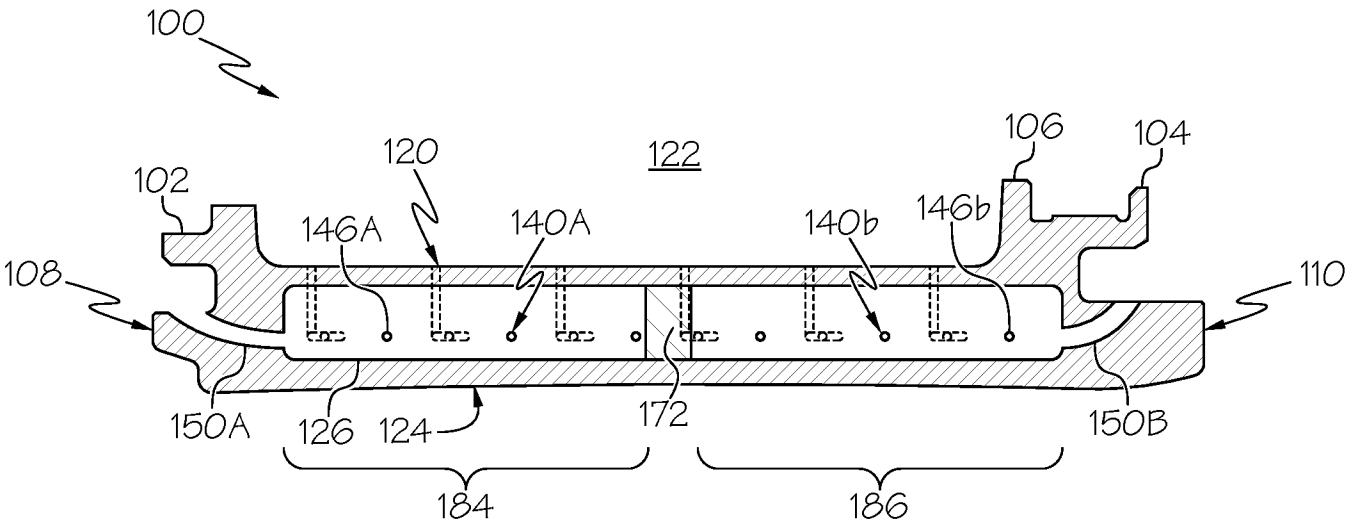
FIG. 19 shows a cross-sectional side view of the turbine shroud taken along line 19-19 in FIG. 18, according to additional embodiments of the disclosure.
Figure 20:
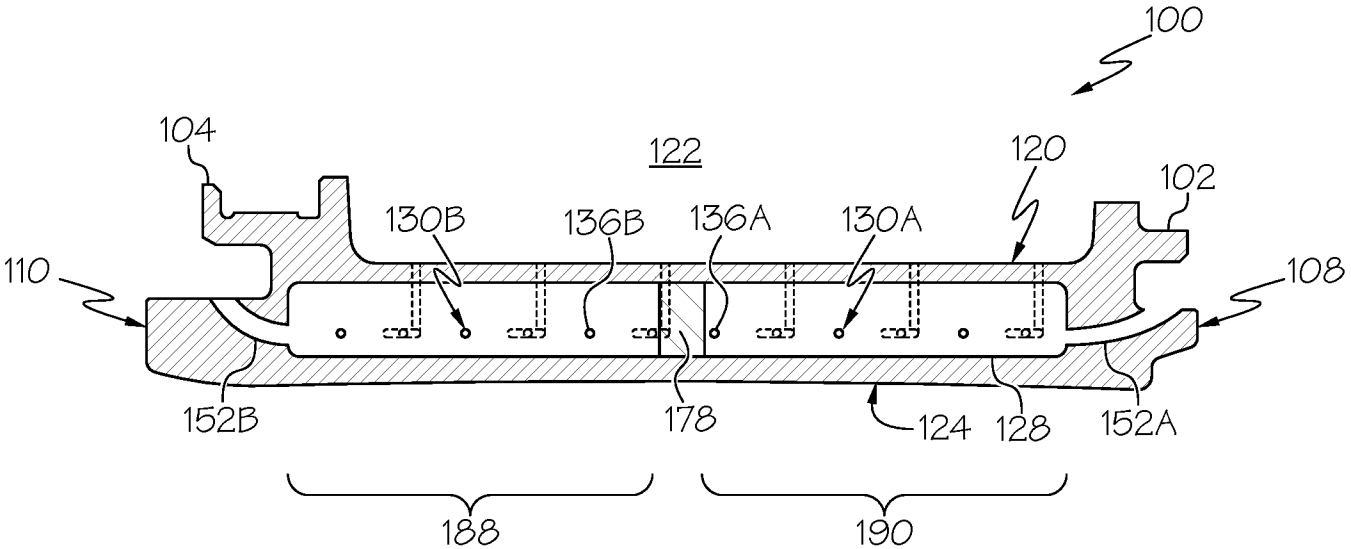
FIG. 20 shows a cross-sectional side view of the turbine shroud taken along line 20-20 in FIG. 18, according to additional embodiments of the disclosure.
Figure 21:
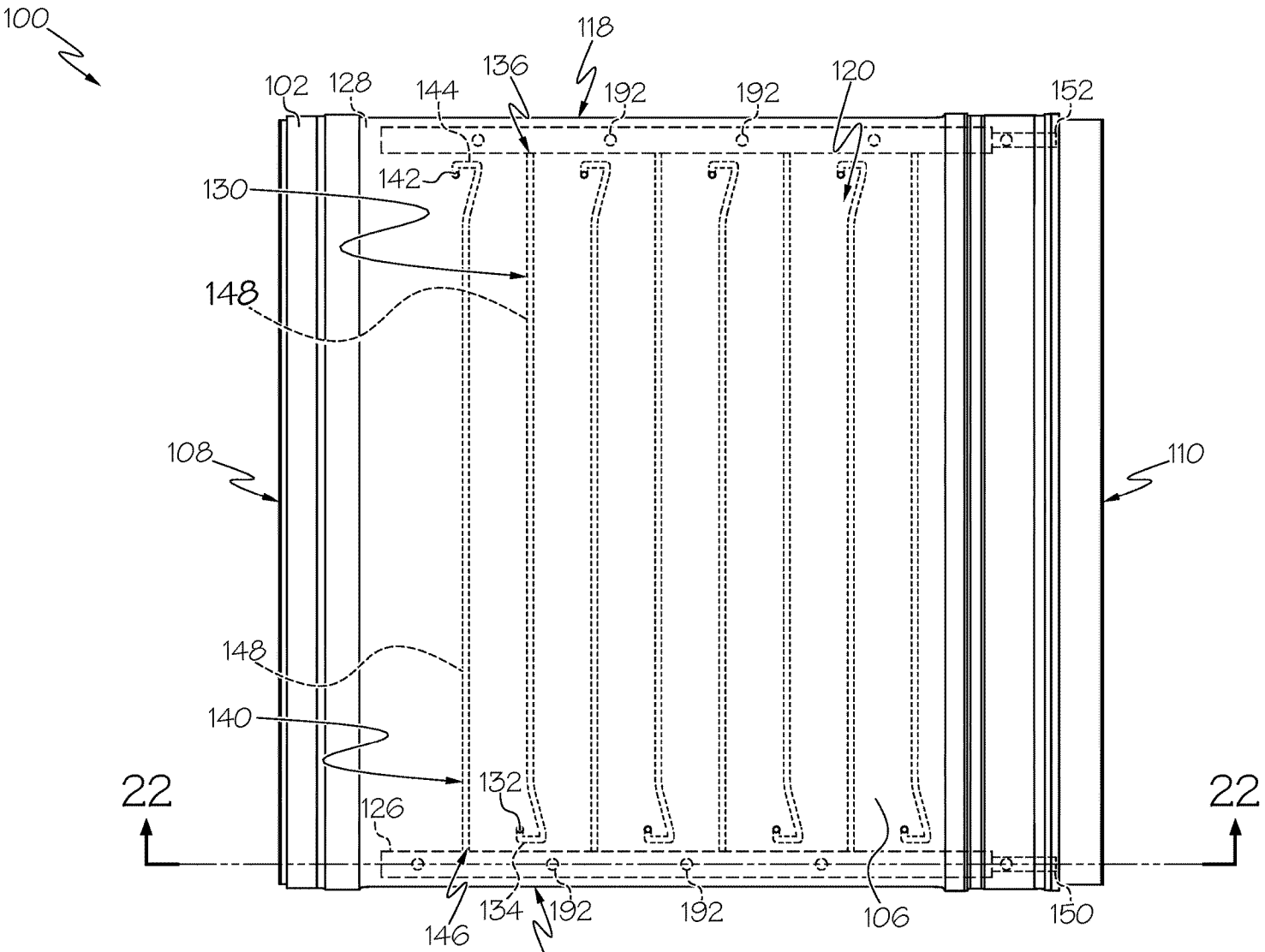
FIG. 21 shows a top view of the turbine shroud of FIG. 3 including support pins formed in the collection plenums, according to embodiments of the disclosure.
Figure 22:
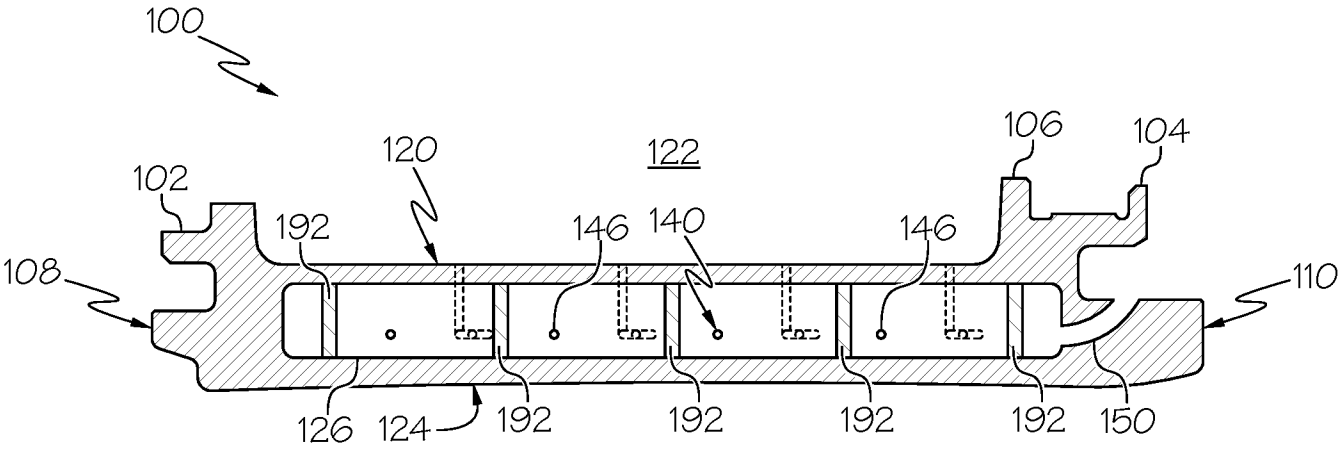
FIG. 22 shows a cross-sectional side view of the turbine shroud taken along line 22-22 in FIG. 21, according to embodiments of the disclosure.
Figure 23:
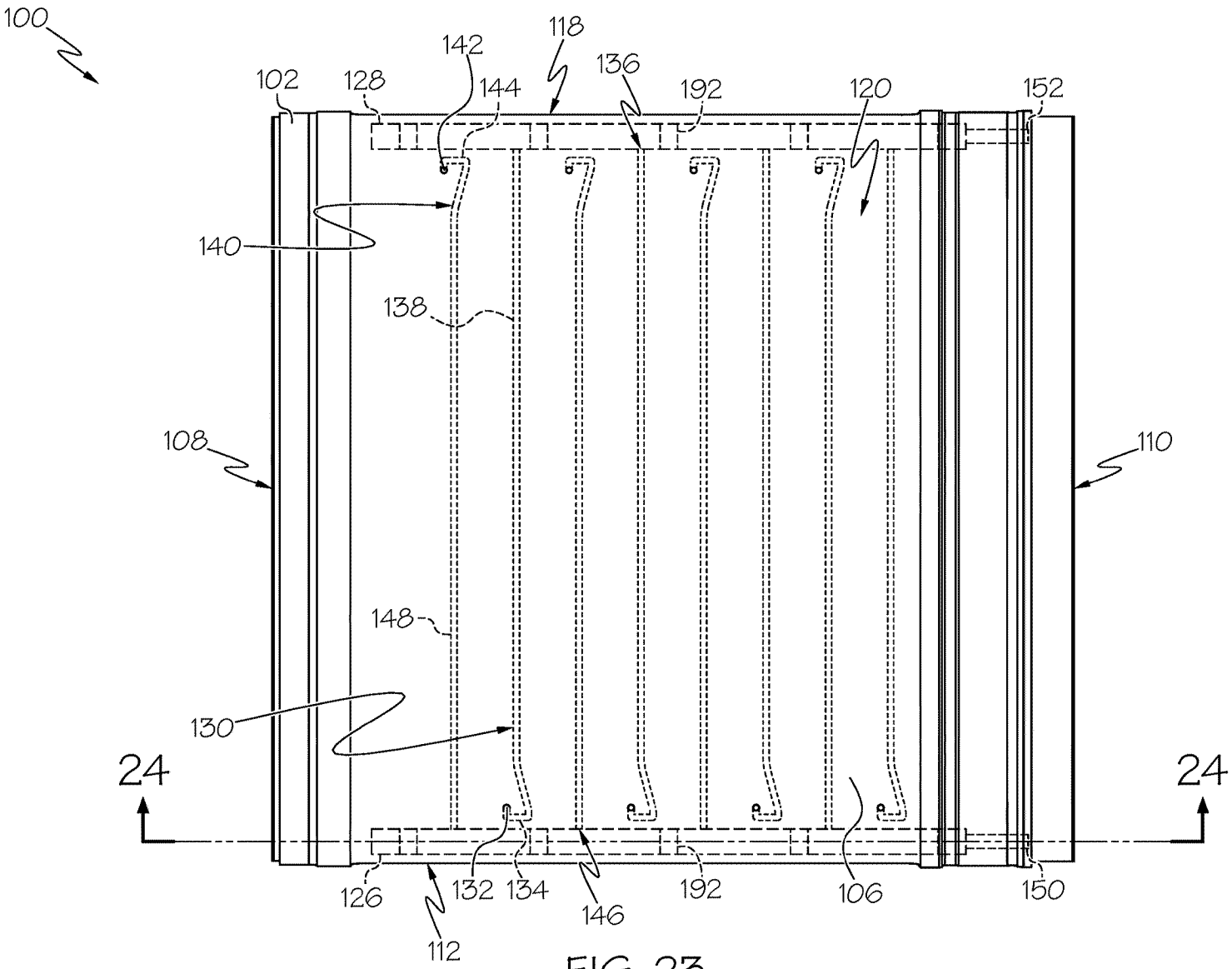
FIG. 23 shows a top view of the turbine shroud of FIG. 3 including support pins formed in the collection plenums, according to additional embodiments of the disclosure.
Figure 24:
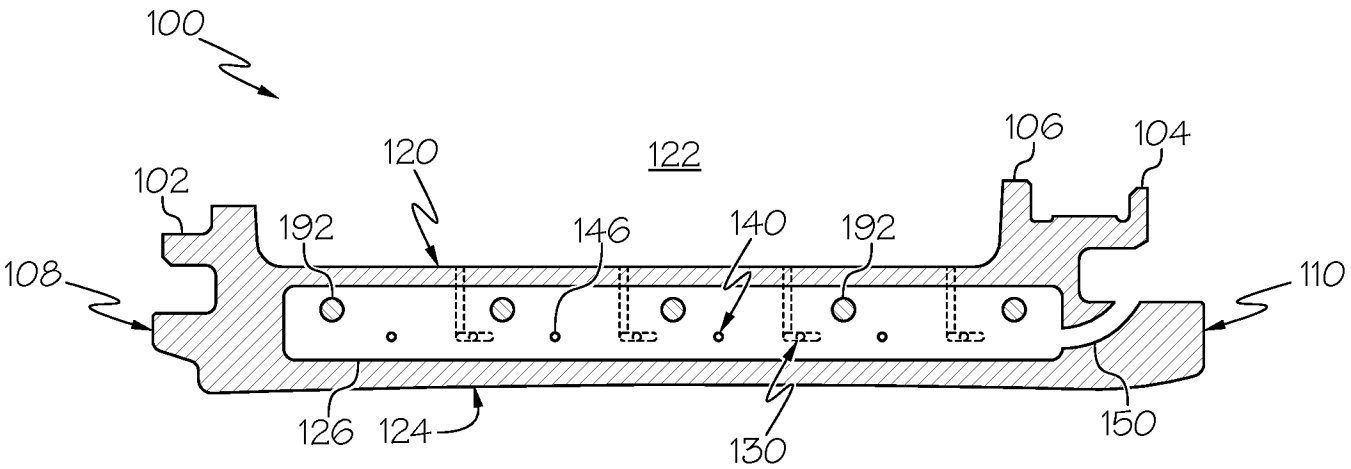
FIG. 24 shows a cross-sectional side view of the turbine shroud taken along line 24-24 in FIG. 23, according to embodiments of the disclosure.

FIGS. 18-20 show various views of a further non-limiting example of turbine shroud 100 of turbine 28 for gas turbine system 10 of FIG. 1. The non-limiting example of turbine shroud 100 shown in FIGS. 18-20 may include similar features as those discussed herein with respect to FIGS. 15-17 oriented and/or positioned in a distinct manner. For example, first wall 172 may extend within first side collection plenum 126 from outer surface 120 to inner surface 124 of body 106, and may be substantially parallel to forward end 108 and aft end 110 of body 106. In the non-limiting example shown in FIGS. 18 and 19, the formation of first wall 172 within first side collection plenum 126 may substantially divide first side collection plenum 126 into a plurality of distinct sections including a forward section 184, and aft section 186. Forward section 184 of first side collection plenum 126 may be formed and/or positioned between first wall 172 and forward end 108 of body 106, and aft section 186 of first side collection plenum 126 may be formed and/or positioned between first wall 172 and aft end 110 of body 106.

Briefly turning to FIGS. 19 and 20, turbine shroud may include two first exhaust holes 150A, 150B that may be in fluid communication with both forward section 184 and aft section 186, respectively. That is first exhaust hole 150A may be in fluid communication with and/or fluidly coupled to forward section 184 to receive and exhaust cooling fluid from forward section 184 of side collection plenum 126. Additionally, first exhaust hole 150A may be formed through forward end 108 of body 106 for turbine shroud 100. In a non-limiting example, first exhaust hole 150A may be in fluid communication with a space or area surrounding an outer platform of a stator vanes (e.g., outer platform 42, stator vanes 40) of turbine 28 (see, FIG. 2) that may be positioned axial upstream of turbine shroud 100. During operation, and as discussed herein, first exhaust hole 150A may discharge cooling fluid from forward section 184 of first side collection plenum 126, adjacent forward end 108 of turbine shroud 100, and into the space or area surrounding the outer platform of stator vanes positioned axially upstream of turbine shroud 100. As shown in FIG. 19, first exhaust hole 150B may be in fluid communication with aft section 186, and may be formed through aft end 110 of body 106, as similarly discussed herein. The cooling fluid discharged from first exhaust holes 150A, 150B may purge, for example, the gap (G) between shroud 100 and outer platform 42 of stator vane 40 of combustion gases 26 (see, FIG. 2), and/or may crossover to outer platform 42 of stator vane 40 and used as cooling and/or leakage for outer platform 42.

Similar to the non-limiting example discussed herein with respect to FIGS. 15-17, the formation of first wall 172 within first side collection plenum 126 may divide the second set of cooling passages 140 in turbine shroud 100 into first group 140A and second group 140B. As shown in FIG. 19, outlet portion 146A of first group 140A of the second set of cooling passages 140A may be in fluid communication with and/or fluidly coupled to forward section 184 of first side collection plenum 126 to provide cooling fluid therein. Additionally, outlet portion 146B of second group 140B of the second set of cooling passages 140A may be in fluid communication with and/or fluidly coupled to aft section 186 to provide cooling fluid to aft section 186 only.

Additionally in the non-limiting example shown in FIGS. 18 and 20, second wall 178 may extend within second side collection plenum 128 from outer surface 120 to inner surface 124 of body 106, and may be substantially parallel to forward end 108 and aft end 110 of body 106. The formation of second wall 178 within second side collection plenum 128 may divide second side collection plenum 128 into a plurality of distinct sections including a forward section 188 and an aft section 190. Similar to sections 184, 186 of first side collection plenum 126, forward section 188 may be formed and/or positioned between second wall 178 and forward end 108 of body 106, and aft section 190 may be formed and/or positioned between second wall 178 and aft end 110 of body 106. Briefly turning to FIG. 20, and similar to first exhaust holes 150A, 150B, second exhaust hole 152A may be in fluid communication with forward section 188 and second exhaust hole 152B may be in fluid communication with aft section 190 to receive and exhaust cooling fluid from the respective section 188, 190 of second side collection plenum 128. Similar to first exhaust hole 150A, the cooling fluid discharged from second exhaust hole 152A may be in fluid communication with a space or area surrounding an outer platform of a stator vanes (e.g., outer platform 42, stator vanes 40) of turbine 28 (see, FIG. 2) that may be positioned axial upstream of turbine shroud 100. Additionally, second exhaust hole 152B may be in fluid communication with the space, area, or gap (G) formed between shroud 100 and outer platform 42 of stator vanes 40 (see, FIG. 2). The cooling fluid discharged from second exhaust holes 152A, 152B may purge, for example, the gap (G) between shroud 100 and outer platform 42 of stator vane 40 of combustion gases 26 (see, FIG. 2), and/or may crossover to outer platform 42 of stator vane 40 and used as cooling and/or leakage for outer platform 42.

As shown in FIG. 20, and with continued reference to FIG. 18, outlet portion 136A of first group 130A of the first set of cooling passages 130A may be in fluid communication with and/or fluidly coupled to forward section 188 of second side collection plenum 128. Outlet portion 136B of second group 130B of the first set of cooling passages 130A may be in fluid communication with and/or fluidly coupled to aft section 190. As such, first group 130A of the first set of cooling passages 130A may provide cooling fluid only to forward section 188 of second side collection plenum 128, and second group 130B of the first set of cooling passages 130A may provide cooling fluid only to aft section 190 of second side collection plenum 128.

Although shown and discussed herein with respect to FIGS. 15-20 as only including a single wall 172, 178, first side collection plenum 126 and/or second side collection plenum 128 may include more walls formed therein. In the non-limiting example where first side collection plenum 126 and/or second side collection plenum 128 include a plurality of walls formed therein, first side collection plenum 126 and/or second side collection plenum 128 may include a plurality of distinct sections formed between the walls and/or body 106 of turbine shroud 100, as similarly discussed herein.

Additionally, it is understood that the formation and/or position of the exhaust holes in turbine shroud 100 shown in the non-limiting examples of FIGS. 15-20 is illustrative. As such, exhaust holes 150, 152, 150A, 150B, 152A, 152B may be formed in or through various portions of turbine shroud 100. For example, first exhaust holes 150A, 150B may be formed through first side 112 of body 106 for turbine shroud 100, and second exhaust holes 152A, 152B may be formed through second side 118. In this non-limiting example, the cooling fluid discharged from exhaust holes 150A, 150B, 152A, 152B may be exhausted in a space or area formed between to circumferentially adjacent turbine shrouds to purge the space between the shrouds and/or used for cooling (e.g., film cooling) the circumferentially adjacent turbine shrouds.

FIGS. 21-24 show additional non-limiting examples of turbine shroud 100 including additional features. In the non-limiting examples, turbine shroud 100 may include a plurality of support pins 192. The plurality of support pins 192 may be positioned, formed, and/or extend within first side collection plenum 126 and/or second side collection plenum 128 of turbine shroud 100. In the non-limiting example shown in FIGS. 21 and 22, the plurality of support pins 192 may extend within first side collection plenum 126 and/or second side collection plenum 128, and may extend between outer surface 120 and inner surface 124 of body 106. In the non-limiting example shown in FIGS. 23 and 24, the plurality of support pins 192 may extend within first side collection plenum 126 between first side 112 and body 106 of turbine shroud 100. Additionally in the non-limiting example, the plurality of support pins 192 may extend within second side collection plenum 126 between second side 118 and body 106 of turbine shroud 100. In a non-limiting example where body 106 is formed as a unitary body, the plurality of support pins 192 may be formed integral with body 106 of turbine shroud 100 using any suitable additive manufacturing process(es) and/or method.

The plurality of support pins 192 formed within turbine shroud 100 may be formed within first side collection plenum 126 and/or second side collection plenum 128 to provide support, structure, and/or rigidity to first side collection plenum 126 and/or second side collection plenum 128. In addition to providing support, structure, and/or rigidity to first side collection plenum 126 and/or second side collection plenum 128, the plurality of support pins 192 may also aid in the heat transfer and/or cooling of turbine shroud 100 during operation of gas turbine system 10 (see, FIG. 1), as discussed herein. The size, shape, and/or number of support pins 192 extending within first side collection plenum 126 and/or second side collection plenum 128 is merely illustrative. As such, turbine shroud 100 may include larger of smaller support pins 192, varying sized support pins 192, and/or may include more or less support pins 192 formed therein.

Figure 25:
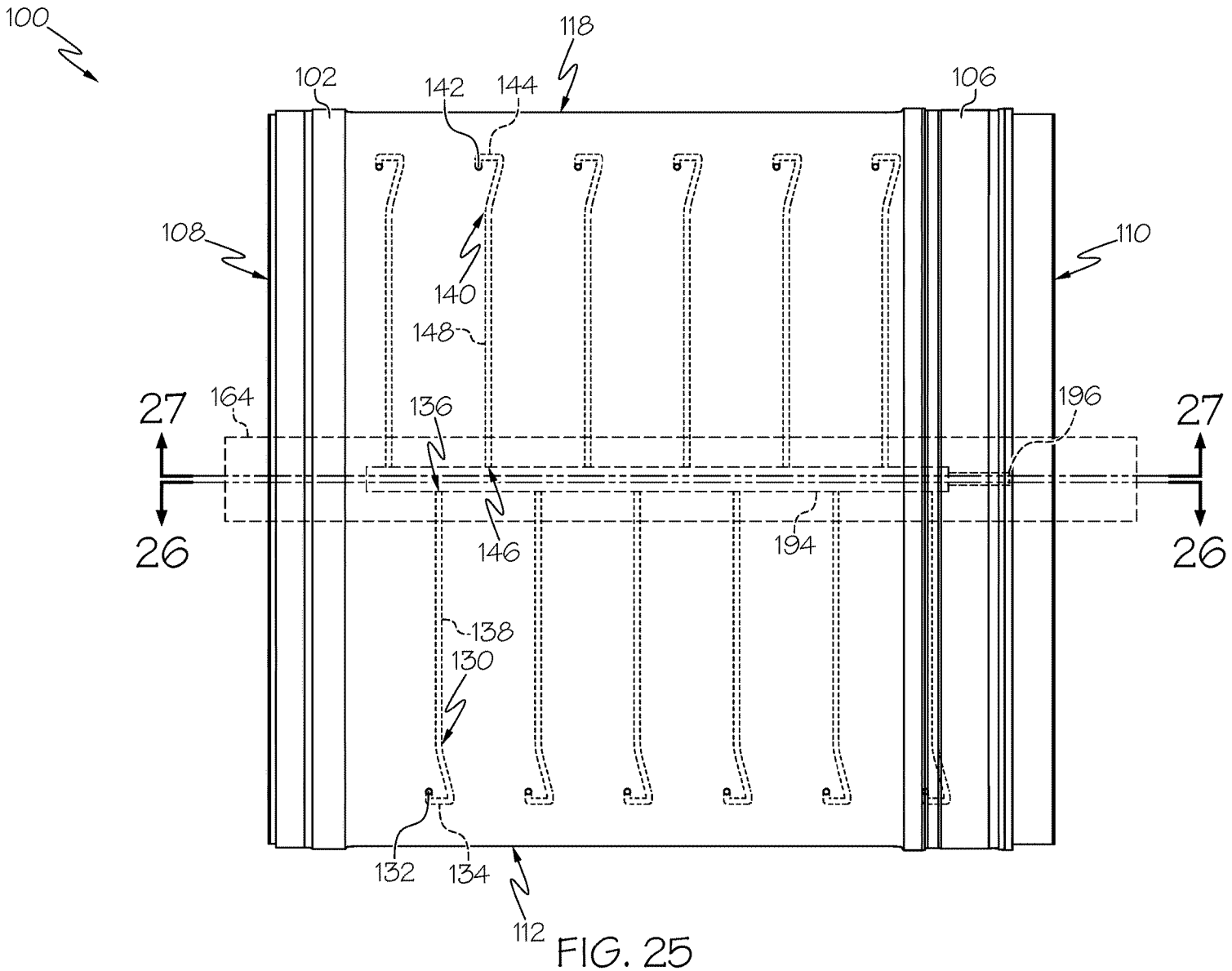
FIG. 25 shows a top view of the turbine shroud of FIG. 3 including a central collection plenum, according to embodiments of the disclosure.
Figure 26:
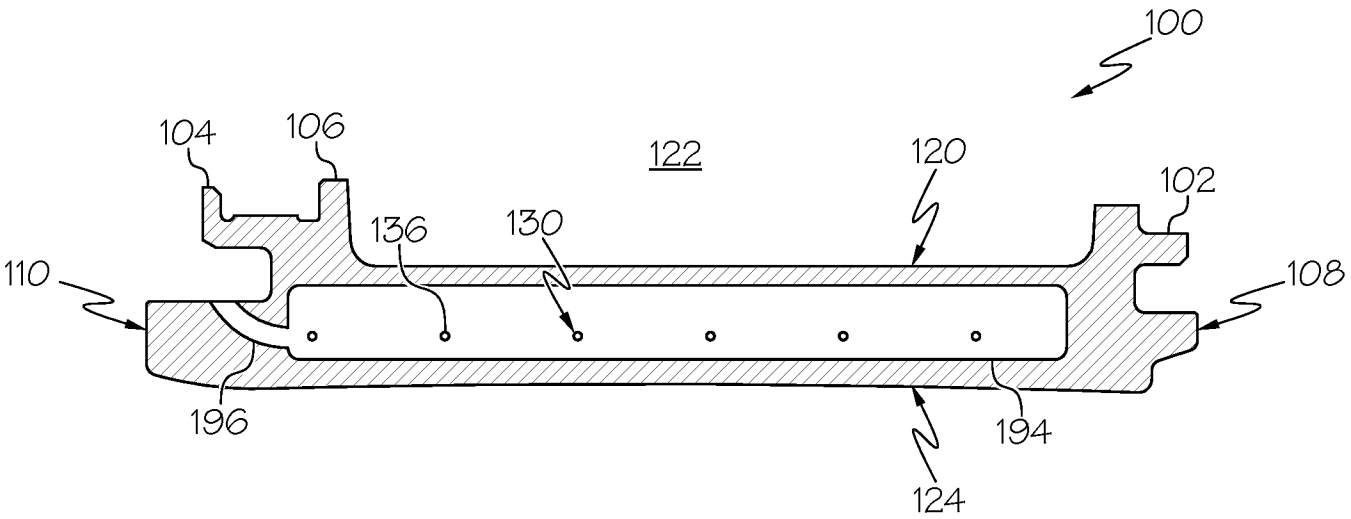
FIG. 26 shows a cross-sectional side view of the turbine shroud taken along line 26-26 in FIG. 25, according to embodiments of the disclosure.
Figure 27:
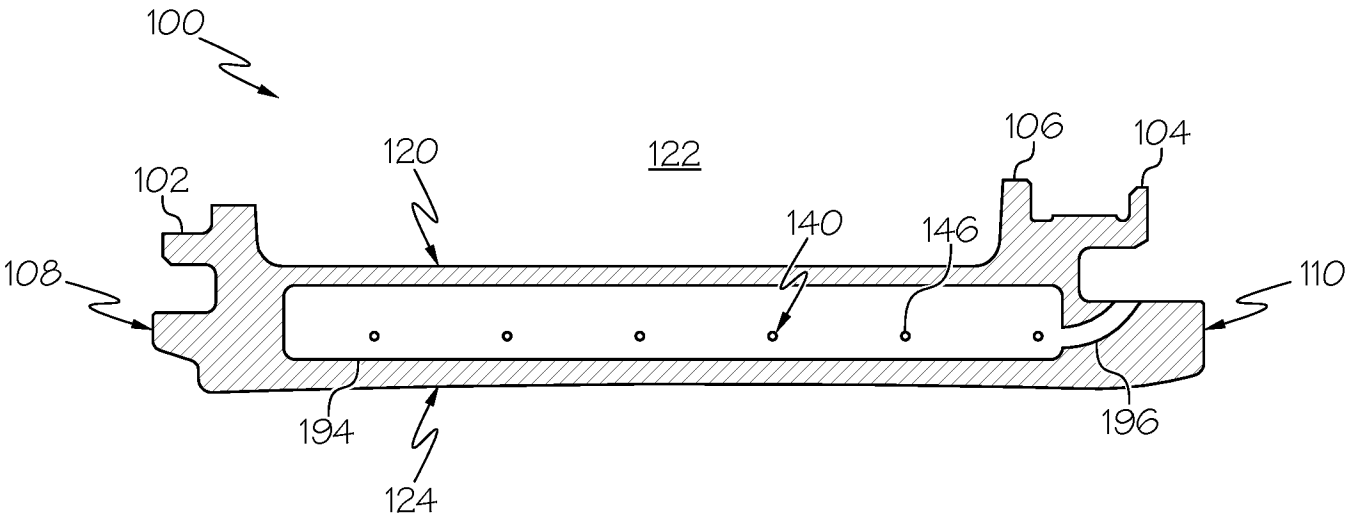
FIG. 27 shows a cross-sectional side view of the turbine shroud taken along line 27-27 in FIG. 25, according to embodiments of the disclosure.

FIGS. 25-27 show various views of another non-limiting example of turbine shroud 100 of turbine 28 for gas turbine system 10 of FIG. 1. Specifically, FIG. 25 shows a top view of turbine shroud 100, FIG. 26 shows a cross-sectional side view of turbine shroud 100 taken along line 26-26 in FIG. 25, and FIG. 27 shows a cross-sectional side view of turbine shroud 100 taken along line 27-27 in FIG. 25. It is understood that similarly numbered and/or named components may function in a substantially similar fashion. Redundant explanation of these components has been omitted for clarity.

Distinct from the non-limiting examples discussed herein, turbine shroud 100 shown in FIGS. 25-27 may include a single, central collection plenum 194. Central collection plenum 194 may extend within body 106 from forward end 108 to aft end 110, between first side 112 and second side 118. More specifically, central collection plenum 194 may extend within in central region 164 of body 106, between, and substantially parallel to first side 112 and second side 118. Briefly turning to FIGS. 26 and 27, central collection plenum 194 may extend within body 106 between outer surface 120 and inner surface 124 of body 106.

The non-limiting example of turbine shroud 100 shown in FIGS. 25-27 may include first set of cooling passages 130, and second set of cooling passages 140, as similarly discussed herein. However, at least a portion of first set of cooling passages 130, and second set of cooling passages 140 may be positioned within turbine shroud 100 in a distinct manner in order to provide cooling fluid to central collection plenum 194. For example, and as shown in FIG. 25, first set of cooling passages 130 may be formed, positioned, and/or extend within body 106 from near first side 112 of body 106 to central collection plenum 194. As similarly discussed herein, inlet portion 132 of first set of cooling passages 130 may be positioned adjacent first side 112. However in the non-limiting example shown in FIG. 25, outlet portion 136 of first set of cooling passages 130 may be positioned adjacent and/or may be in direct fluid communication with central collection plenum 194. As a result, intermediate portion 138 of first set of cooling passages 130 may not extend substantially over an entire width between first side 112 and second side 118 of body 106 (e.g. see, FIG. 4). Rather, intermediate portion 138 may only extend between inlet portion 132 positioned adjacent first side 112, and outlet portion 136 in fluid communication with central collection plenum 194 formed within central region 164 of body 106 for turbine 100.

Similar to first set of cooling passages 130, second set of cooling passages 140 may be formed, positioned, and/or extend within body 106 from near second side 118 of body 106 to central collection plenum 194. In the non-limiting example, inlet portion 142 of second set of cooling passages 140 may be positioned adjacent second side 118, and outlet portion 146 of second set of cooling passages 140 may be positioned adjacent and/or may be in direct fluid communication with central collection plenum 194. In this non-limiting example, both first set of cooling passages 130 and second set of cooling passages 140 may provide cooling fluid to central collection plenum 194 during operation of turbine 28 (see, FIGS. 1 and 2), as discussed herein.

Also shown in FIGS. 25-27, turbine shroud 100 may also include exhaust hole 196. Exhaust hole 196 may be in fluid communication with central collection plenum 194. More specifically, exhaust hole 196 may be in fluid communication with and may extend axially from central collection plenum 194 of turbine shroud 100. In the non-limiting example shown in FIGS. 25-27, exhaust hole 196 may extend through body 106, from central collection plenum 194 to and/or through aft end 110 of body 106 for turbine shroud 100. Similar to first exhaust hole 150 discussed herein (see, FIGS. 4-6), exhaust hole 196 may be in fluid communication with a space or area surrounding outer platform 42 of stator vanes 40 of turbine 28 (see, FIG. 2). During operation, and as discussed herein, exhaust hole 196 may discharge cooling fluid from central collection plenum 194, adjacent aft end 110 of turbine shroud 100, and into the space or area surrounding outer platform 42 of stator vanes 40. Also as discussed herein, exhaust hole 196 in fluid communication with central collection plenum 194 may be sized and/or include a geometry to ensure that central collection plenum 194 maintains a desired, internal pressure. By maintaining the desired, internal pressure within central collection plenum 194, the cooling fluid provided by cooling passages 130, 140 may continuously flow through central collection plenum 194, be provided to broken or damaged cooling passages via central collection plenum 194 (where applicable), and be exhaust from exhaust hole 196, as discussed herein.

Figure 28:
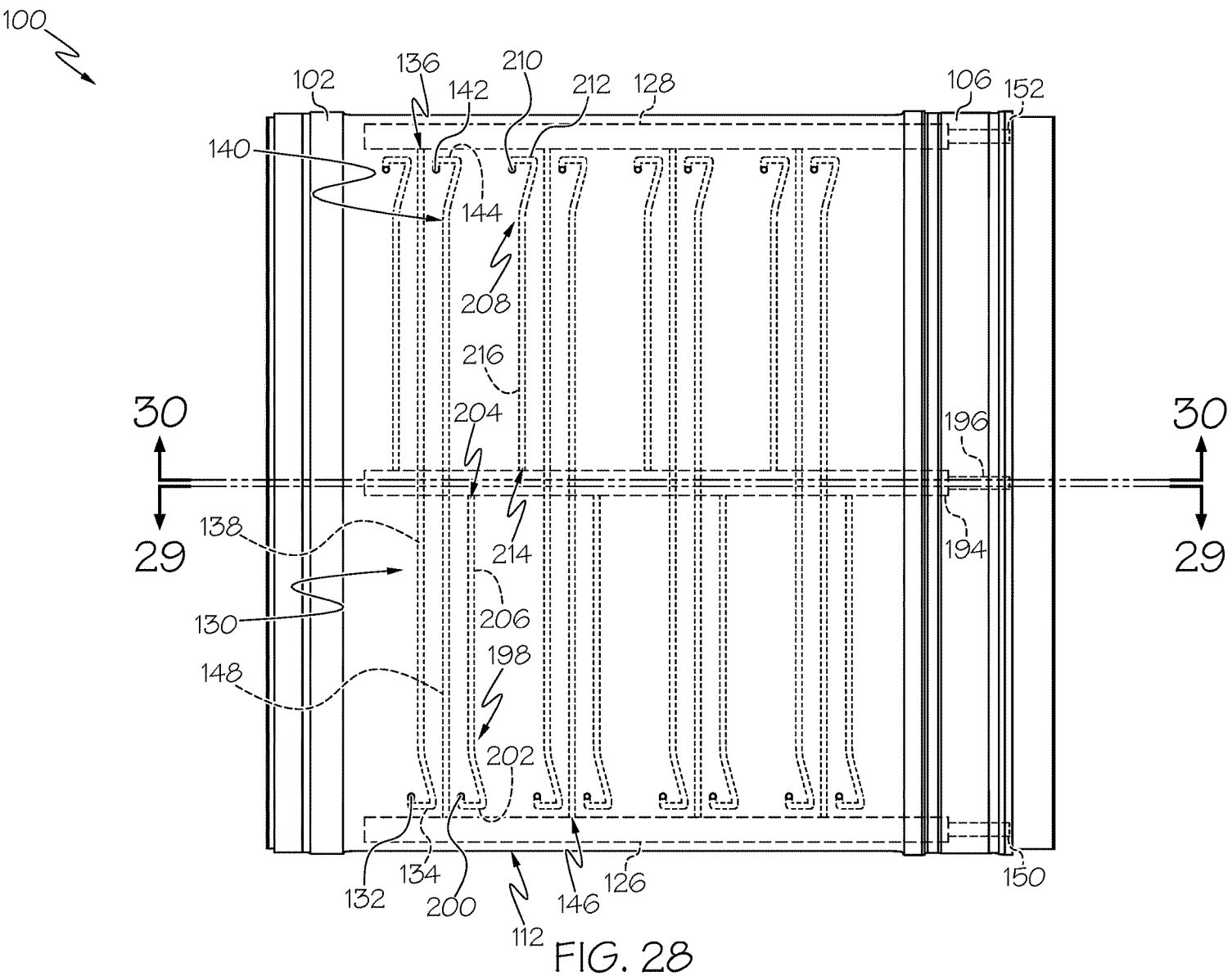
FIG. 28 shows a top view of the turbine shroud of FIG. 3 including two side collection plenums and a central collection plenum, according to embodiments of the disclosure.
Figure 29:
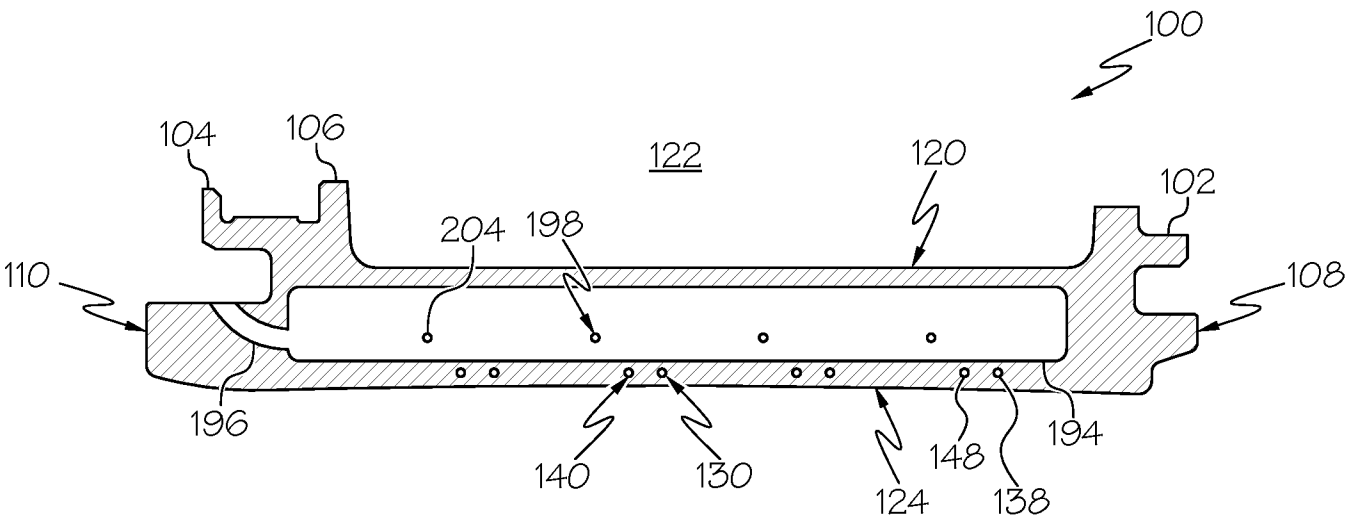
FIG. 29 shows a cross-sectional side view of the turbine shroud taken along line 29-29 in FIG. 28, according to embodiments of the disclosure.
Figure 30:
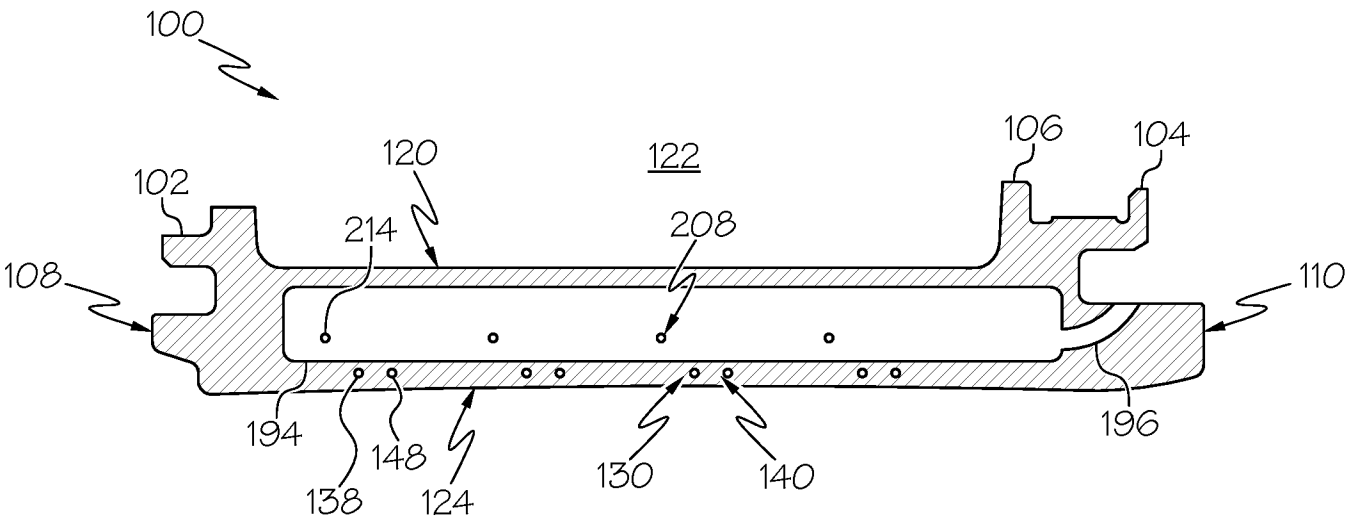
FIG. 30 shows a cross-sectional side view of the turbine shroud taken along line 30-30 in FIG. 28, according to embodiments of the disclosure.

FIGS. 28-30 show various views of another non-limiting example of turbine shroud 100 include first side collection plenum 126, second side collection plenum 128, and central collection plenum 194. Turbine shroud 100 including first side collection plenum 126, second side collection plenum 128, and central collection plenum 194 may include similar features and components as those discussed herein with respect to, for example, FIGS. 4-6, and 25-27. Redundant explanation of these features and components have been omitted for clarity.

Distinct for the non-limiting examples discussed herein, the non-limiting example shown in FIGS. 28-30 may also include a third set of cooling passages 198. Third set of cooling passages 198 may be substantially similar to first set of cooling passages 130 shown and discussed herein with respect to FIGS. 25-27. That is, and as shown in FIG. 28, third set of cooling passages 198 may be formed, positioned, and/or extend within body 106 from near first side 112 of body 106 to central collection plenum 194. More specifically, inlet portion 200, including hook-shaped section 202, of third set of cooling passages 198 may be positioned adjacent first side 112 of body 106. Additionally, and similar to inlet portion 132 of first set of cooling passages 130, inlet portion 200 of third set of cooling passages 198 may be positioned adjacent first side collection plenum 126, such that first side collection plenum 126 is positioned between inlet portion 200 of third set of cooling passages 198 and first side 112 of body 106. Additionally, third set of cooling passages 198 may include outlet portion 204 extending within body 106, and intermediate portion 206 extending within body 106, and fluidly coupling inlet portion 200 and outlet portion 204. As shown in FIGS. 28 and 29, outlet portion 204 may also be positioned adjacent to and/or in direct fluid communication with central collection plenum 194. In the non-limiting example, third set of cooling passages 198, and more specifically outlet portion 204, may provide cooling fluid to central collection plenum 194 during operation of turbine 28 (see, FIG. 2), as discussed herein.

Turbine shroud 100 shown in FIGS. 28-30 may also include a fourth set of cooling passages 208. Fourth set of cooling passages 208 may be substantially similar to second set of cooling passages 140 shown and discussed herein with respect to FIGS. 25-27. Fourth set of cooling passages 208 may be formed, positioned, and/or extend within body 106 from adjacent second side 118 of body 106 to central collection plenum 194. More specifically, inlet portion 210, including hook-shaped section 212, of fourth set of cooling passages 208 may be positioned adjacent second side 118 of body 106. Additionally, and similar to inlet portion 142 of second set of cooling passages 140, inlet portion 210 of fourth set of cooling passages 208 may be positioned adjacent second side collection plenum 128, and/or second side collection plenum 128 may be positioned between inlet portion 210 of fourth set of cooling passages 208 and second side 118 of body 106. Additionally, fourth set of cooling passages 208 may include outlet portion 214 extending within body 106, and intermediate portion 216 extending within body 106, and fluidly coupling inlet portion 208 and outlet portion 214. As shown in the non-limiting of FIGS. 28 and 30, outlet portion 214 may also be positioned adjacent to and/or in direct fluid communication with central collection plenum 194. In the non-limiting example, fourth set of cooling passages 208, and more specifically outlet portion 214, may provide cooling fluid to central collection plenum 194 during operation of turbine 28 (see, FIG. 2), as discussed herein.

Also distinct for the non-limiting examples discussed herein, the cooling passages of the first set of cooling passages 130 and second set of cooling passages 140 may be positioned, formed in, and/or extend through body 106 in a distinct manner. As shown in FIGS. 29 and 30, intermediate portion 138 for each cooling passage of first set of cooling passages 130, and intermediate portion 148 for each cooling passage of second set of cooling passages 140 may extend within body 106 radially below central collection plenum 194. More specifically, intermediate portions 138 of first set of cooling passages 130 and intermediate portions 148 of second set of cooling passages 140 may extend within body 106 between inner surface 124 of body 106 and central collection plenum 194. By extending within body 106 between inner surface 124 of body 106 and central collection plenum 194, intermediate portions 138 may transmit cooling fluid from inlet portion 132 positioned adjacent first side 112 to outlet portion 136 and/or second side collection plenum 128 positioned adjacent second side 118. Similarly, intermediate portions 148 may transmit cooling fluid from inlet portion 142 positioned adjacent second side 118 to outlet portion 146 and/or first side collection plenum 126 positioned adjacent first side 112.

Figure 31:
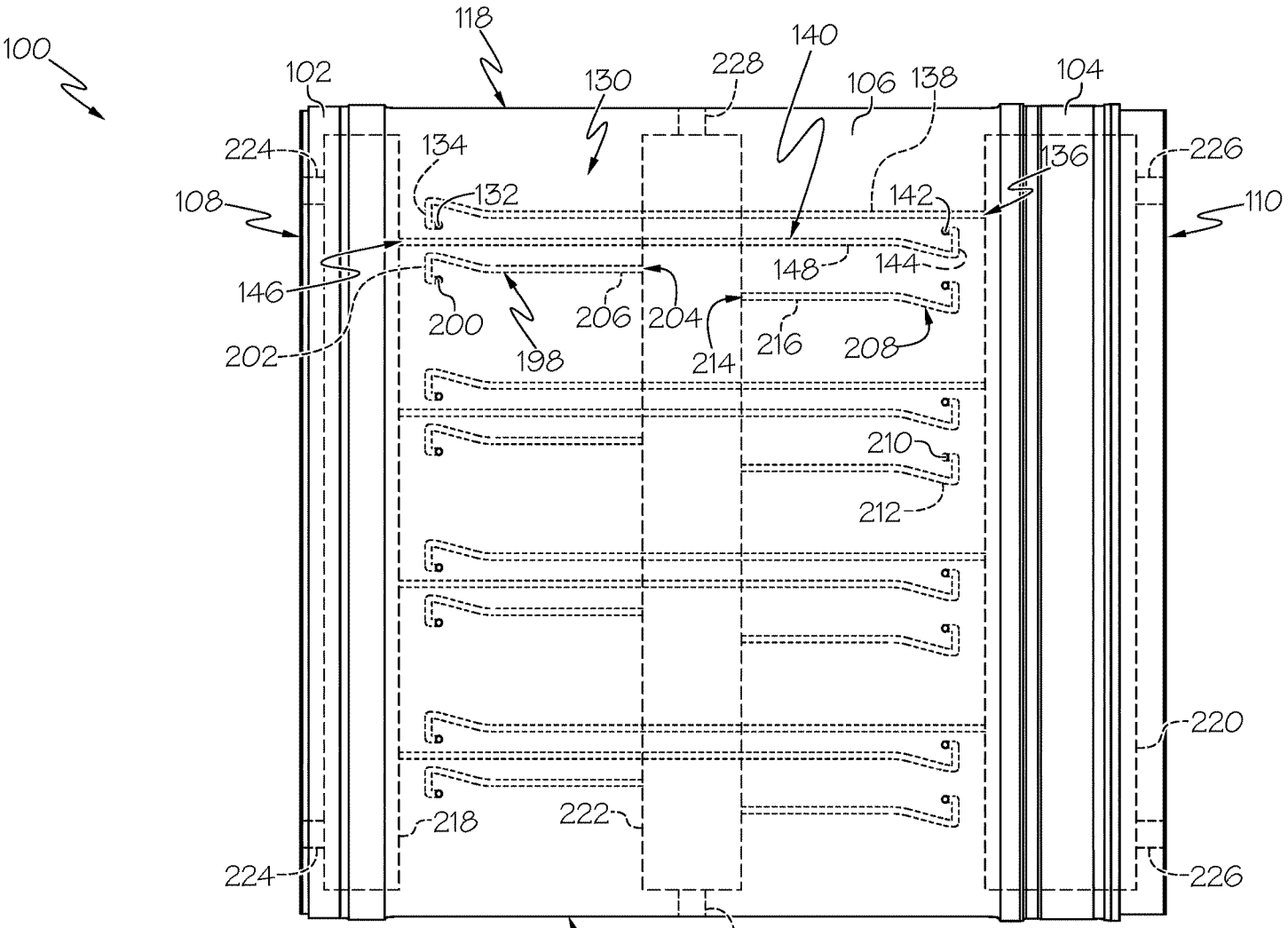
FIG. 31 shows a top view of the turbine shroud of FIG. 3 including a forward collection plenum, an aft collection plenum, and a middle collection plenum, according to embodiments of the disclosure.

FIG. 31 show a top view of another non-limiting example of turbine shroud 100 of turbine 28 for gas turbine system 10 of FIG. 1. It is understood that similarly numbered and/or named components may function in a substantially similar fashion. Redundant explanation of these components has been omitted for clarity.

In the non-limiting example, turbine shroud 100 may include at least one collection plenum extending within body 106 from adjacent first side 112 to adjacent second side 118. In the non-limiting example shown in FIG. 31, turbine shroud 100 may include a forward collection plenum 218. Forward collection plenum 218 may extend within body 106 from adjacent first side 112 to adjacent second side 118. Additionally, forward collection plenum 218 may extend within body 106 adjacent to and/or substantially parallel with forward end 108 of body 106. Forward collection plenum 218 may extend within body 106 between outer surface 120 and inner surface 124 of body 106, as similarly discussed herein (e.g., first side collection plenum 126; FIG. 5).

Turbine shroud 100 shown in FIG. 31 may also include aft collection plenum 220. Aft collection plenum 220 may extend within body 106 from adjacent first side 112 to adjacent second side 118. Additionally, aft collection plenum 220 may extend within body 106 adjacent to and/or substantially parallel with aft end 110 of body 106. Similar to forward collection plenum 118, aft collection plenum 220 may extend within body 106 between outer surface 120 and inner surface 124 of body 106, as similarly discussed herein (e.g., first side collection plenum 126; FIG. 5).

Turbine shroud 100 may also include a middle collection plenum 222 extending within body 106 from adjacent first side 112 to adjacent second side 118. In the non-limiting example shown in FIG. 31, middle collection plenum 222 may extending within body 106 between, and distanced from forward collection plenum 218 and aft collection plenum 220. Additionally, middle collection plenum 222 may extend within body 106 between, and may extend substantially parallel to, forward end 108 and aft end 110 of body 106.

Turbine shroud 100 shown in FIG. 31 may also include a plurality of sets of cooling passages. More specifically, turbine shroud 100 may include first set of cooling passages 130, second set of cooling passages 140, third set of cooling passages 198, and fourth set of cooling passages 208. The plurality of sets of cooling passages 130, 140, 198, 208 shown in the non-limiting example of FIG. 31 may include similar features as those discussed herein (e.g., inlet portion, outlet portion, intermediate portion) oriented and/or positioned in a distinct portion of turbine shroud 100. For example, and as shown in FIG. 31, first set of cooling passages 130 may extend within body 106 from adjacent forward end 108 to adjacent aft end 110 of body 106. As such, inlet portion 132 of first set of cooling passages 130 may be positioned adjacent forward end 108 and/or forward collection plenum 218, such that forward collection plenum 218 is positioned or extends between forward end 108 of body 106 and outlet portion 132 for first set of cooling passages 130. Additionally, outlet portion 136 of first set of cooling passages 130 may be positioned adjacent aft end 110 of body 106, and may be in fluid communication with aft collection plenum 220.

Also shown in FIG. 31, second set of cooling passages 140 may extend within body 106 from adjacent aft end 110 to adjacent forward end 108 of body 106. As such, inlet portion 142 of second set of cooling passages 140 may be positioned adjacent aft end 110 and/or aft collection plenum 220, such that aft collection plenum 220 is positioned or extends between aft end 110 of body 106 and outlet portion 142 for second set of cooling passages 140. Outlet portion 146 of second set of cooling passages 140 may be positioned adjacent forward end 108 of body 106, and may be in fluid communication with forward collection plenum 218.

Similar to the non-limiting example discussed herein with respect to FIGS. 28-30, intermediate portion 138 for each cooling passage of first set of cooling passages 130, and intermediate portion 148 for each cooling passage of second set of cooling passages 140 shown in FIG. 31 may extend within body 106 radially below middle collection plenum 222. More specifically, intermediate portions 138 of first set of cooling passages 130 and intermediate portions 148 of second set of cooling passages 140 may extend within body 106 between inner surface 124 of body 106 and middle collection plenum 222.

Third set of cooling passages 198 may be formed, positioned, and/or extend within body 106 from adjacent forward end 108 of body 106 to middle collection plenum 222. More specifically, inlet portion 200, including hook-shaped section 202, of third set of cooling passages 198 may be positioned adjacent forward end 108 of body 106 and forward collection plenum 218. As such, forward collection plenum 218 may be positioned between inlet portion 200 of third set of cooling passages 198 and forward end 108 of body 106. Additionally, third set of cooling passages 198 may include outlet portion 204 extending within body 106, and intermediate portion 206 extending within body 106, and fluidly coupling inlet portion 200 and outlet portion 204. As shown in FIG. 31, outlet portion 204 may also be positioned adjacent to and/or in direct fluid communication with middle collection plenum 222. In the non-limiting example, third set of cooling passages 198, and more specifically outlet portion 204, may provide cooling fluid to middle collection plenum 222 during operation of turbine 28 (see, FIG. 2), as discussed herein.

The non-limiting example of turbine shroud 100 shown in FIG. 31 may also include fourth set of cooling passages 208 formed, positioned, and/or extending within body 106 from adjacent aft end 110 of body 106 to middle collection plenum 222. More specifically, inlet portion 210, including hook-shaped section 212, of fourth set of cooling passages 208 may be positioned adjacent aft end 110 of body 106. Additionally, and similar to inlet portion 142 of second set of cooling passages 140, inlet portion 210 of fourth set of cooling passages 208 may be positioned adjacent aft collection plenum 220, such that aft collection plenum 220 may be positioned between inlet portion 208 of fourth set of cooling passages 208 and aft end 110 of body 106. Additionally, fourth set of cooling passages 208 may include outlet portion 214 extending within body 106, and intermediate portion 216 extending within body 106, and fluidly coupling inlet portion 208 and outlet portion 214. As shown in the non-limiting of FIG. 31, outlet portion 214 may also be positioned adjacent to and/or in direct fluid communication with middle collection plenum 222. In the non-limiting example, fourth set of cooling passages 208, and more specifically outlet portion 214, may provide cooling fluid to middle collection plenum 222 during operation of turbine 28 (see, FIG. 2), as discussed herein.

In the non-limiting example shown in FIG. 31, each of forward collection plenum 218, aft collection plenum 220, and middle plenum 222 may include a plurality of exhaust holes. More specifically, forward collection plenum 218 may include a plurality of exhaust holes 224 formed through forward end 108 of body 106. In a non-limiting example, the plurality of exhaust holes 224 formed through forward end 108 of body 106 may be in fluid communication with a space or area surrounding an outer platform of a stator vanes (e.g., outer platform 42, stator vanes 40) of turbine 28 (see, FIG. 2) that may be positioned axial upstream of turbine shroud 100. During operation, and as discussed herein, the plurality of exhaust holes 224 may discharge cooling fluid from forward collection plenum 218, adjacent forward end 108 of turbine shroud 100, and into the space or area surrounding the outer platform of stator vanes positioned axially upstream of turbine shroud 100.

Additionally, aft collection plenum 220 may include a plurality of exhaust holes 226 formed through aft end 110 of body 106. The plurality of exhaust holes 226 may be in fluid communication with a space or area surrounding outer platform 42 of stator vanes 40 of turbine 28 (see, FIG. 2). During operation, and as discussed herein, the plurality of exhaust holes 226 may discharge cooling fluid from aft collection plenum 220, adjacent aft end 110 of turbine shroud 100, and into the space or area surrounding outer platform 42 of stator vanes 40. The cooling fluid discharged from aft collection plenum 220 via the plurality of exhaust holes 226 may purge the gap (G) between shroud 100 and outer platform 42 of stator vane 40 of combustion gases 26 (see, FIG. 2), and/or may crossover to outer platform 42 of stator vane 40 and used as cooling and/or leakage for outer platform 42.

Middle collection plenum 222 may include a plurality of exhaust holes 228 formed through first side 112 and second side 118, respectively, of body 106. The plurality of exhaust holes 228 of middle collection plenum 222 may include at least one exhaust hole 228 formed through each of first side 112 and second side 118 of body 106. In a non-limiting example, the plurality of exhaust holes 228 formed through first side 112 and second side 118 of body 106 may be in fluid communication with a space or area between circumferentially adjacent turbine shrouds of turbine 28 (see, FIG. 2). During operation, and as discussed herein, the plurality of exhaust holes 228 may discharge cooling fluid from middle collection plenum 222, adjacent first side 112 and second side 118, respectively, of turbine shroud 100, and into the space or area positioned between circumferentially adjacent turbine shrouds. The cooling fluid exhaust from middle collection plenum 222 via the plurality of exhaust holes 228 may be exhausted into the space or area above or below the seals (not shown) included on the circumferentially adjacent turbine shrouds.

Figure 32:
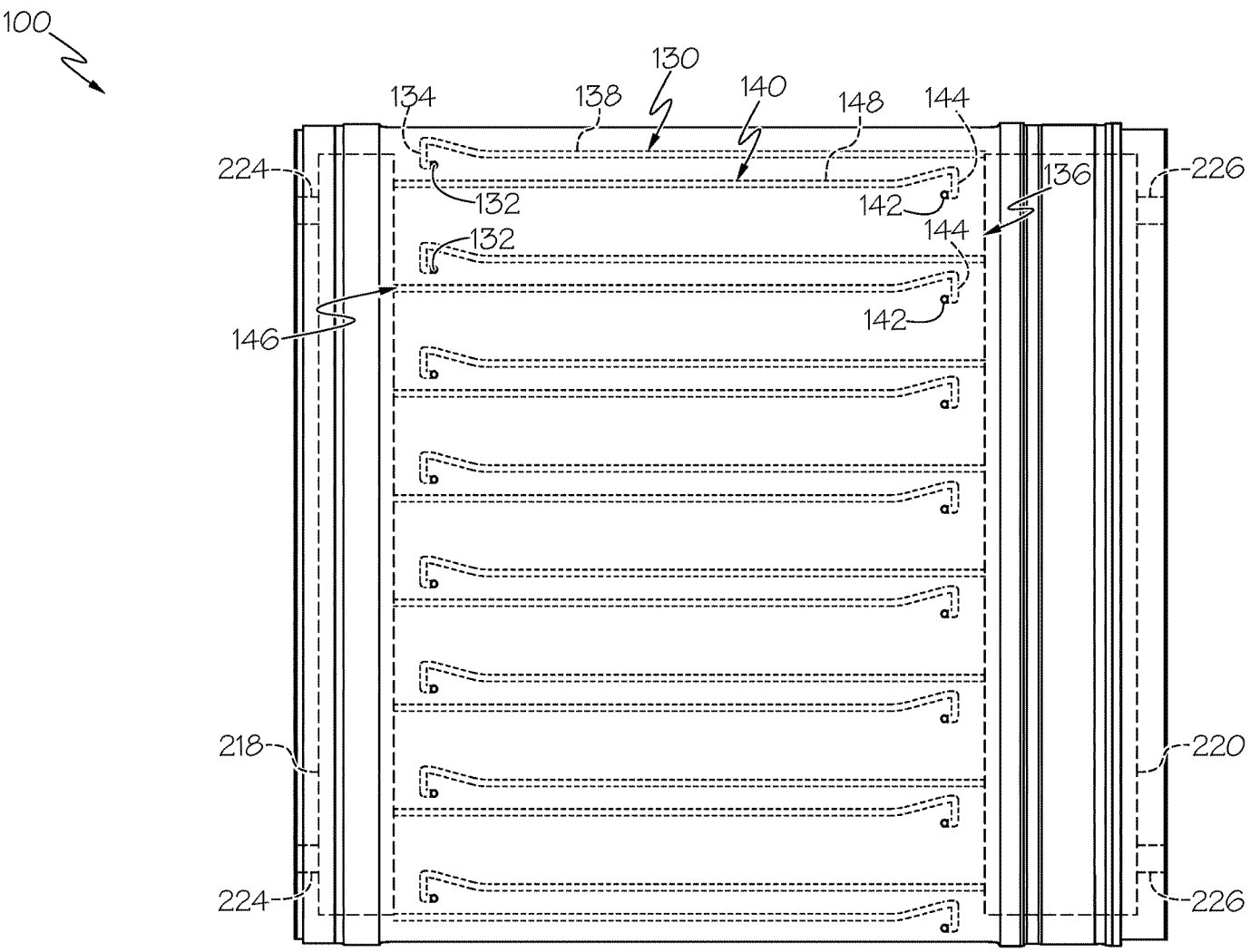
FIG. 32 shows a top view of the turbine shroud of FIG. 3 including a forward collection plenum, and an aft collection plenum, according to embodiments of the disclosure.
Figure 33:
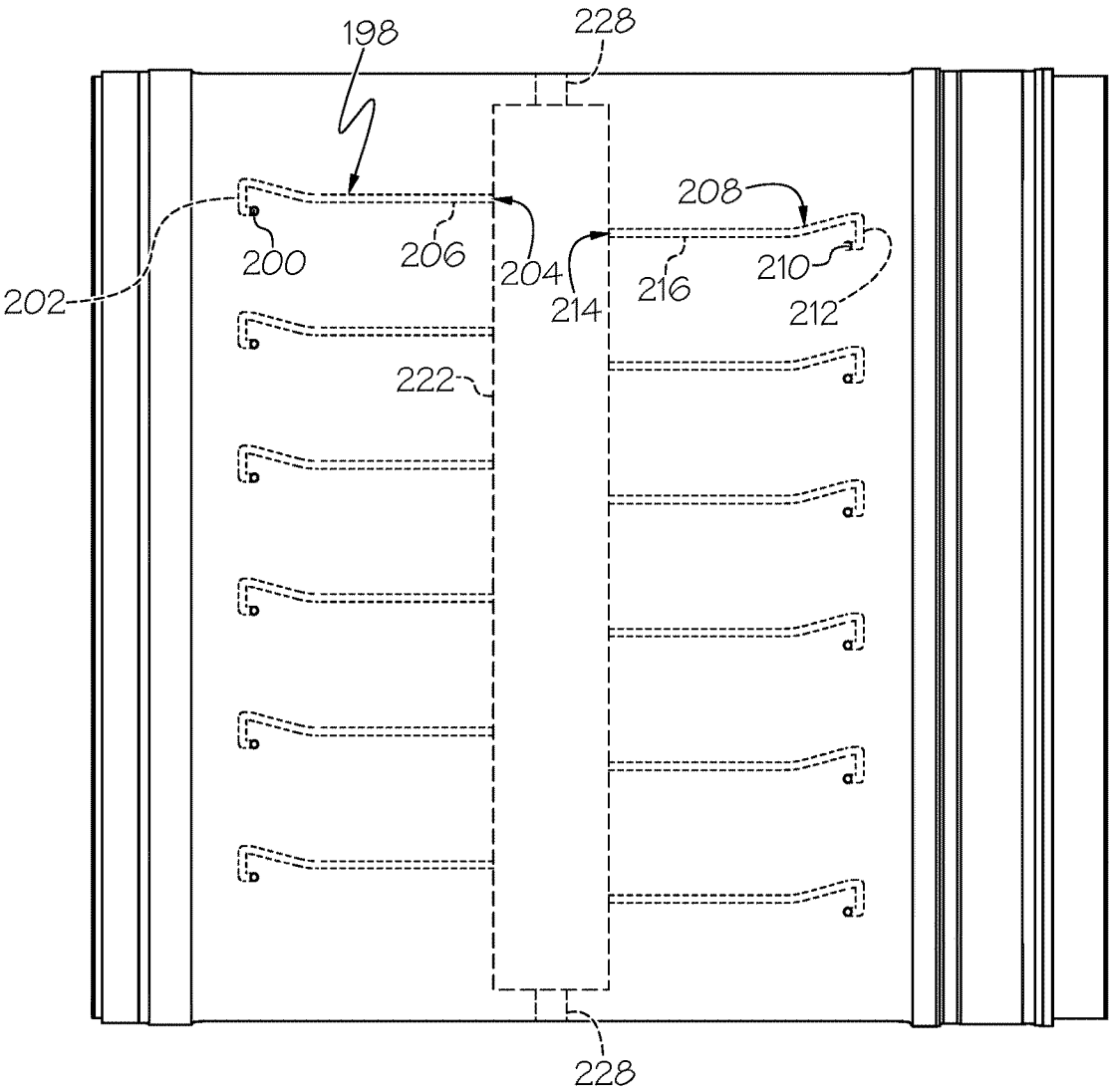
FIG. 33 shows a top view of the turbine shroud of FIG. 3 including a middle collection plenum, according to embodiments of the disclosure.

FIGS. 32 and 33 show top views of distinct, non-limiting examples of turbine shroud 100 that may be similar to the non-limiting example of turbine shroud 100 shown in FIG. 31. For example, FIG. 32 shows a non-limiting example of turbine shroud 100 including only forward collection plenum 218 and aft collection plenum 220. In this non-limiting example, turbine shroud 100 may also only include the first set of cooling passage 130, the second set of cooling passage 140, the plurality of exhaust holes 224 in fluid communication with forward collection plenum 218, and the plurality of exhaust holes 226 in fluid communication with aft collection plenum 220. In the non-limiting example shown in FIG. 33, turbine shroud 100 may only include middle collection plenum 222. In this non-limiting example, turbine shroud 100 may also only include the third set of cooling passage 198, the fourth set of cooling passage 208, and the plurality of exhaust holes 228 in fluid communication with middle collection plenum 222.

Although shown as including three collection plenums 218, 220, 222 (FIG. 31), two collection plenums 218, 220 (FIG. 32), or middle collection plenum 222 (FIG. 33), it is understood that turbine shroud 100 may include any combination or number of plenums formed therein and extending between sides 112, 118 of turbine shroud 100. For example (not shown), turbine shroud 100 may include only aft collection plenum 220. In the non-limiting example where turbine shroud 100 includes only aft collection plenum 220, turbine shroud 100 may also only include first set of cooling passages 130 in fluid communication with aft collection plenum 220, and plurality of exhaust holes 226.

Technical effects of the invention include, e.g., providing a turbine shroud that includes at least one collection plenum that may use the cooling fluid flowing through a plurality of cooling passages of the turbine to provide additional cooling within the turbine shroud. During operation, further technical effects include exhausting the cooling fluid to distinct portions of the turbine system using the turbine shroud.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Another aspect of the embodiments includes a turbine shroud coupled to a turbine casing of a turbine system. The turbine shroud includes: a forward end; an aft end positioned opposite the forward end; a first side extending between forward end and aft end; a second side extending between forward end and aft end, opposite the first side; an outer surface facing a cooling chamber formed between the body and the turbine casing; and an inner surface facing a hot gas flow path for the turbine system; at least one collection plenum extending within the body between the forward end and the aft end; and at least one set of cooling passages extending within the body, each of the cooling passages of the at least one set of cooling passages including: an inlet portion extending through the outer surface and in fluid communication with the cooling chamber formed between the body and the turbine casing; an outlet portion in fluid communication with the at least one collection plenum; and an intermediate portion fluidly coupling the inlet portion and the outlet portion. The at least one collection plenum includes a first side collection plenum extending within the body adjacent the first side of the body; and a second side collection plenum extending within the body adjacent the second side of the body, with the first side collection plenum further having at least one wall extending within the first side collection plenum between the outer surface of the body and the inner surface of the body, and the at least one wall dividing the first side collection plenum into a plurality of distinct sections.

Another aspect of the embodiments includes a turbine shroud coupled to a turbine casing of a turbine system. The turbine shroud includes: a forward end; an aft end positioned opposite the forward end; a first side extending between forward end and aft end; a second side extending between forward end and aft end, opposite the first side; an outer surface facing a cooling chamber formed between the body and the turbine casing; and an inner surface facing a hot gas flow path for the turbine system; at least one collection plenum extending within the body between the forward end and the aft end; and at least one set of cooling passages extending within the body, each of the cooling passages of the at least one set of cooling passages including: an inlet portion extending through the outer surface and in fluid communication with the cooling chamber formed between the body and the turbine casing; an outlet portion in fluid communication with the at least one collection plenum; and an intermediate portion fluidly coupling the inlet portion and the outlet portion. The at least one collection plenum includes a first side collection plenum extending within the body adjacent the first side of the body and a second side collection plenum extending within the body adjacent the second side of the body, with the first side collection plenum further including at least one wall extending within the first side collection plenum from the forward end to the aft end of the body. The at least one wall dividing the first side collection plenum into a plurality of distinct sections.

An additional aspect of the disclosure provides a turbine shroud coupled to a turbine casing of a turbine system. The turbine shroud includes: a body including: a forward end; an aft end positioned opposite the forward end; a first side extending between forward end and aft end; a second side extending between forward end and aft end, opposite the first side; an outer surface facing a cooling chamber formed between the body and the turbine casing; and an inner surface facing a hot gas flow path for the turbine system; at least one collection plenum extending within the body between the first side and the second side; and at least one set of cooling passages extending within the body, each of the cooling passages of the at least one set of cooling passages including: an inlet portion extending through the outer surface and in fluid communication with the cooling chamber formed between the body and the turbine casing; an outlet portion in fluid communication with the at least one collection plenum; and an intermediate portion fluidly coupling the inlet portion and the outlet portion. The at least one collection plenum includes at least one of a forward collection plenum formed within the body adjacent the forward end of the body, an aft collection plenum formed within the body adjacent the aft end of the body, or a middle collection plenum extending within the body between the forward end and the aft end.

What is claimed is:

1. A turbine shroud coupled to a turbine casing of a turbine system, the turbine shroud comprising:

a body including:

a forward end;

an aft end positioned opposite the forward end;

a first side extending between forward end and aft end;

a second side extending between forward end and aft end, opposite the first side;

an outer surface facing a cooling chamber formed between the body and the turbine casing; and an inner surface facing a hot gas flow path for the turbine system;

at least one collection plenum extending within the body between the forward end and the aft end; and at least one set of cooling passages extending within the body, each of the cooling passages of the at least one set of cooling passages including:

an inlet portion extending through the outer surface and in fluid communication with the cooling chamber formed between the body and the turbine casing;

an outlet portion in fluid communication with the at least one collection plenum; and an intermediate portion fluidly coupling the inlet portion and the outlet portion, wherein the at least one collection plenum includes:

a first side collection plenum extending within the body adjacent the first side of the body; and a second side collection plenum extending within the body adjacent the second side of the body, and wherein the at least one set of cooling passages includes:

a first set of cooling passages extending from adjacent the first side of the body to adjacent the second side and returning to the first side, the inlet portion for each of the first set of cooling passages positioned adjacent the first side and the outlet portion for each of the first set of cooling passages in fluid communication with the first side collection plenum; and a second set of cooling passages extending from adjacent the second side of the body to adjacent the first side and returning to the second side, the inlet portion for each of the second set of cooling passages positioned adjacent the second side and the outlet portion for each of the second set of cooling passages in fluid communication with the second side collection plenum.

2. The turbine shroud of claim 1, wherein the at least one set of cooling passages includes:

a first set of cooling passages extending from adjacent the first side of the body to adjacent the second side, the inlet portion for each of the first set of cooling passages positioned adjacent the first side of the body and the outlet portion for each of the first set of cooling passages in fluid communication with the second side collection plenum; and a second set of cooling passages extending from adjacent the second side of the body to adjacent the first side, the inlet portion for each of the second set of cooling passages positioned adjacent the second side of the body and the outlet portion for each of the second set of cooling passages in fluid communication with the first side collection plenum.

3. The turbine shroud of claim 2, wherein:

the first side collection plenum is positioned between the first side of the body and the inlet portion for each of the first set of cooling passages, and the second side collection plenum is positioned between the second side of the body and the inlet portion for each of the second set of cooling passages.

4. The turbine shroud of claim 2, further comprising:

at least one first exhaust hole in fluid communication with the first side collection plenum, the at least one first exhaust hole extending through at least one of the aft end or the inner surface of the body; and at least one second exhaust hole in fluid communication with the second side collection plenum, the at least one second exhaust hole extending through at least one of the aft end or the inner surface of the body.

5. The turbine shroud of claim 4, wherein:

the at least one first exhaust hole includes one of a predetermined diameter or a tapered geometry to determine an internal pressure of the first side collection plenum, and the at least one second exhaust hole includes one of the predetermined diameter or the tapered geometry to determine an internal pressure of the second side collection plenum.

6. A turbine shroud coupled to a turbine casing of a turbine system, the turbine shroud comprising:

a body including:

a forward end;

an aft end positioned opposite the forward end;

a first side extending between forward end and aft end;

a second side extending between forward end and aft end, opposite the first side;

an outer surface facing a cooling chamber formed between the body and the turbine casing; and an inner surface facing a hot gas flow path for the turbine system;

at least one collection plenum extending within the body between the forward end and the aft end; and at least one set of cooling passages extending within the body, each of the cooling passages of the at least one set of cooling passages including:

an inlet portion extending through the outer surface and in fluid communication with the cooling chamber formed between the body and the turbine casing;

an outlet portion in fluid communication with the at least one collection plenum; and an intermediate portion fluidly coupling the inlet portion and the outlet portion, wherein the at least one collection plenum includes:

a first side collection plenum extending within the body adjacent the first side of the body; and a second side collection plenum extending within the body adjacent the second side of the body, and the turbine shroud further comprising:

at least one coupling conduit extending within the body, the at least one coupling conduit extending between and fluidly coupling the first side collection plenum and the second side collection plenum.

7. The turbine shroud of claim 6, wherein the at least one set of cooling passages includes:

a first set of cooling passages extending from adjacent the first side of the body to adjacent the second side, the inlet portion for each of the first set of cooling passages positioned adjacent the first side of the body and the outlet portion for each of the first set of cooling passages in fluid communication with the second side collection plenum; and a second set of cooling passages extending from adjacent the second side of the body to adjacent the first side, the inlet portion for each of the second set of cooling passages positioned adjacent the second side of the body and the outlet portion for each of the second set of cooling passages in fluid communication with the first side collection plenum.

8. The turbine shroud of claim 7, wherein:

the first side collection plenum is positioned between the first side of the body and the inlet portion for each of the first set of cooling passages, and the second side collection plenum is positioned between the second side of the body and the inlet portion for each of the second set of cooling passages.

9. The turbine shroud of claim 7, further comprising:

at least one first exhaust hole in fluid communication with the first side collection plenum, the at least one first exhaust hole extending through at least one of the aft end or the inner surface of the body; and at least one second exhaust hole in fluid communication with the second side collection plenum, the at least one second exhaust hole extending through at least one of the aft end or the inner surface of the body.

10. The turbine shroud of claim 7, wherein:

the at least one first exhaust hole includes one of a predetermined diameter or a tapered geometry to determine an internal pressure of the first side collection plenum, and the at least one second exhaust hole includes one of the predetermined diameter or the tapered geometry to determine an internal pressure of the second side collection plenum.

11. A turbine shroud coupled to a turbine casing of a turbine system, the turbine shroud comprising:

a body including:

a forward end;

an aft end positioned opposite the forward end;

a first side extending between forward end and aft end;

a second side extending between forward end and aft end, opposite the first side;

an outer surface facing a cooling chamber formed between the body and the turbine casing; and an inner surface facing a hot gas flow path for the turbine system;

at least one collection plenum extending within the body between the forward end and the aft end; and at least one set of cooling passages extending within the body, each of the cooling passages of the at least one set of cooling passages including:

an inlet portion extending through the outer surface and in fluid communication with the cooling chamber formed between the body and the turbine casing;

an outlet portion in fluid communication with the at least one collection plenum; and an intermediate portion fluidly coupling the inlet portion and the outlet portion, wherein the at least one collection plenum includes a central collection plenum extending within the body between the first side of the body and the second side of the body, and wherein the at least one set of cooling passages includes:

a first set of cooling passages extending from adjacent the first side of the body to the central collection plenum, the inlet portion for each of the first set of cooling passages positioned adjacent the first side and the outlet portion for each of the first set of cooling passages in fluid communication with the central collection plenum; and a second set of cooling passages extending from adjacent the second side of the body to the central collection plenum, the inlet portion for each of the second set of cooling passages positioned adjacent the second side and the outlet portion for each of the second set of cooling passages in fluid communication with the central collection plenum.

12. The turbine shroud of claim 11, wherein the at least one collection plenum includes:

a first side collection plenum extending within the body adjacent the first side of the body; and a second side collection plenum extending within the body adjacent the second side of the body.

13. The turbine shroud of claim 12, wherein the at least one set of cooling passages includes:

a first set of cooling passages extending from adjacent the first side of the body to adjacent the second side, the inlet portion for each of the first set of cooling passages positioned adjacent the first side of the body and the outlet portion for each of the first set of cooling passages in fluid communication with the second side collection plenum; and a second set of cooling passages extending from adjacent the second side of the body to adjacent the first side, the inlet portion for each of the second set of cooling passages positioned adjacent the second side of the body and the outlet portion for each of the second set of cooling passages in fluid communication with the first side collection plenum.

14. The turbine shroud of claim 13, wherein:

the first side collection plenum is positioned between the first side of the body and the inlet portion for each of the first set of cooling passages, and the second side collection plenum is positioned between the second side of the body and the inlet portion for each of the second set of cooling passages.

15. The turbine shroud of claim 13, further comprising:

at least one first exhaust hole in fluid communication with the first side collection plenum, the at least one first exhaust hole extending through at least one of the aft end or the inner surface of the body; and at least one second exhaust hole in fluid communication with the second side collection plenum, the at least one second exhaust hole extending through at least one of the aft end or the inner surface of the body.

16. The turbine shroud of claim 15, wherein:

the at least one first exhaust hole includes one of a predetermined diameter or a tapered geometry to determine an internal pressure of the first side collection plenum, and the at least one second exhaust hole includes one of the predetermined diameter or the tapered geometry to determine an internal pressure of the second side collection plenum.

17. The turbine shroud of claim 15, wherein the at least one collection plenum further includes:

a central collection plenum extending within the body between the first side collection plenum and the second side collection plenum.

* * * * *